US009027366B2

(12) United States Patent
Raynor

(10) Patent No.: US 9,027,366 B2
(45) Date of Patent: May 12, 2015

(54) SYSTEM AND METHOD FOR FORMING A DESIGN FROM A FLEXIBLE FILAMENT HAVING INDICATORS

(76) Inventor: Alida Cathleen Raynor, Seattle, WA (US)

( * ) Notice: Subject to any disclaimer, the term of this patent is extended or adjusted under 35 U.S.C. 154(b) by 1334 days.

(21) Appl. No.: 12/683,673

(22) Filed: Jan. 7, 2010

(65) Prior Publication Data

US 2011/0162414 A1 Jul. 7, 2011

(51) Int. Cl.
*D04B 3/00* (2006.01)

(52) U.S. Cl.
CPC ..... *D04B 3/00* (2013.01)

(58) Field of Classification Search
CPC ..... D04B 3/00; D04B 3/02; D04B 1/10; D04B 1/12
USPC ..... 66/169 R, 1 R, 1 A, 1.5, 3, 4
See application file for complete search history.

(56) References Cited

U.S. PATENT DOCUMENTS 3,025,528 A * 3/1962 Minter ..... 2/144
4,328,984 A * 5/1982 Hampton ..... 289/1.2
4,640,529 A * 2/1987 Katz ..... 281/5
4,814,218 A * 3/1989 Shane ..... 428/102
5,088,118 A * 2/1992 Whiteley ..... 2/144
5,864,881 A * 2/1999 Simmons ..... 2/145
5,890,381 A * 4/1999 Leeke et al. ..... 66/170
5,970,697 A * 10/1999 Jacobs et al. ..... 57/22
6,082,412 A * 7/2000 Wildeman et al. ..... 139/1 R
6,494,362 B1 * 12/2002 Harmon ..... 235/375
7,430,882 B2 10/2008 Nakayama
7,431,055 B2 10/2008 Debaes et al.
8,348,318 B2 * 1/2013 Petiot et al. ..... 294/74
2008/0007077 A1 * 1/2008 Petiot et al. ..... 294/149
2009/0038521 A1 * 2/2009 Allen ..... 112/475.17
2009/0198260 A1 * 8/2009 Ford et al. ..... 606/151
2009/0209978 A1 * 8/2009 Nelson et al. ..... 606/139
2009/0288278 A1 * 11/2009 Ota ..... 28/164

* cited by examiner

*Primary Examiner* — Danny Worrell
(74) *Attorney, Agent, or Firm* — Seed IP Law Group PLLC

(57) ABSTRACT

The present disclosure is directed to a flexible filament that includes a length of material configured to be used in forming at least a portion of a textile product to have at least a portion of a visual pattern that is visible on at least one of a first side or a second side of the textile product. The material includes a plurality of stitch indicators formed on the material to separate the material into a plurality of segmented regions, at least one of the stitch indicators or the segmented regions forming at least the portion of the visual pattern visible on the at least one of the first side or the second side of the textile product.

32 Claims, 33 Drawing Sheets

SYSTEM AND METHOD FOR FORMING A DESIGN FROM A FLEXIBLE FILAMENT HAVING INDICATORS

BACKGROUND

1. Technical Field

The present disclosure relates to a system and method for forming a product having a preselected design using a flexible filament having a plurality of indicators and a plurality of segments that correspond to the design.

2. Description of the Related Art

Humans have manipulated flexible filaments or other continuous fibers, such as strands of yarn, to achieve selected designs on textile products for hundreds of years. The designs may include any number of patterns with varying degrees of complexity, from simple stripes to intricate depictions of still-life scenes. Different methods of forming the textile products include among other things knitting, crocheting, weaving, macramé, tatting, embroidery, hooking, knotting, braiding, cross stitching, sewing, temari balls, basket weaving, latch hooking, beading, punch-needling, Tunisian crochet, Afghan Stitch, Tricot Crochet, Shepherd's Knitting, Hook Knitting, Railroad Knitting, rug hooking, and rug making. Each of these methods requires dexterity and skill in order to produce even the simplest design. In addition, each of these methods has various types of stitches or other sequences of actions that are used to form the textile product. For example, when knitting, a plurality of movements are required to form a single stitch, such as a knit stitch or a purl stitch.

The textile products can include transitions between colors and can incorporate tangible features, such as beading or tassels, into the designs. For example, a manipulator may choose to incorporate beading into a scarf they are knitting to add additional color, weight, or sparkle. In order to incorporate such tangible features at a particular location upon the textile product, the manipulator must incorporate each tangible feature individually. This is a tedious and time consuming endeavor.

In order to change from one color to another during the forming of the textile product, the manipulator must connect the current color of yarn to a different color of yarn. Various methods of integration exist, for example, tying the current color of yarn to the different color of yarn. Alternatively, the manipulator may incorporate the different color into the textile product by working the different color into the textile product simultaneously with the current color at a transition zone until the different color yarn is sufficiently integrated. After the different color is integrated, the manipulator may have to cut the current color, which requires the manipulator to stop what they are doing, put down the uncompleted textile product, and use a pair of scissors or other cutting device.

Complicated designs with many color transitions are challenging and time consuming for the manipulator. In addition, these transitions from one color of yarn to another can produce a messy or unsightly knot or lump in the final textile product, especially for novice practitioners. More particularly, if knots are employed for the joining of different spools of yarn, the final textile product, such as a blanket, may be less comfortable because of the knots. In addition, if different colored spools of yarn are worked into the textile product by tying knots or by other methods, the ends of the different spools of yarn can protrude out of the textile product, which can make the textile product look messy. Integrating these ends smoothly into the textile product, such that they are unnoticeable, can be a lengthy and difficult process.

Another drawback, is that the color transitions can be wasteful because the manipulator has to buy a separate spool of yarn of each desired color, even if the color is only required in a very small portion of the textile product. After forming the portion of the pattern that requires the particular color, the remainder of that spool of yarn is no longer needed and is often wasted. Many spools of yarn have been discarded into attics or storage closets for this reason. The extra yarn is costly for the manipulator and the environment.

Some spools of yarn have a plurality of colors dispersed throughout the spool of yarn. Although this allows the manipulator to have the plurality of colors in the textile product, the colors are dispersed throughout the yarn, but do not correspond to a preselected pattern of a final product. Recently, manufacturers have begun selling self-striping yarn that includes at least two colors distributed at selected intervals on a strand of yarn. When manipulated, the self-striping yarn automatically forms a striped pattern. If the manipulator is knitting, the manipulator can impact a thickness of the stripes of color by selecting the number of stitches for each row, i.e., a width of a scarf. For example, knitting a scarf with self-striping yarn will form wider stripes than if knitting a blanket with the same self-striping yarn. Although these products allow a manipulator to form a textile product with a single spool of yarn, the design is limited to a stripe or stripes with no specific design for the final product.

The different methods of manipulating a continuous filament, such as yarn, are difficult to learn. For example, knitting requires a certain level of dexterity to control a spool of yarn while holding a plurality of knitting needles and manipulating the yarn around the knitting needle according to a specific stitch. Without experience, it can be difficult to determine the amount of yarn to use for each stitch. Inconsistencies in the stitches can result in a poor final product, for example, loose areas that cause irregularities in shape. These challenges can be particularly acute for children trying to learn these skills.

SUMMARY OF THE INVENTION

The present invention is directed to a yarn or other flexible filament that includes a plurality of stitch indicators and a plurality of segmented regions that cooperate to form a selected design or a visual pattern as a part of a textile product. The stitch indicators may be sensory indications that indicate where a stitch is to be formed to assist a manipulator in forming consistent stitches. The stitch indicators may also be tactile indicators that form a part of the design or pattern. For example, the stitch indicators may be a plurality of colored beads that form an image on one side of the textile product. In addition, the stitch indicators may cooperate with each other or with the segmented regions to form the selected design or a visual pattern without requiring transitions between different spools of yarn at each color change.

The present disclosure thus provides a flexible filament for forming a textile product, the filament including a length of material configured to be used in forming the textile product to have a visual pattern on at least one of a first side or a second side of the textile product. The material includes a plurality of stitch indicators that are spaced at intervals on the material to separate the material into a plurality of segmented regions, at least one of the stitch indicators or the segmented regions forming at least a portion of the visual pattern on the at least one of the first side or the second side of the textile product, wherein the at least one stitch indicator provides a first sensory indication of where at least one part of a maneuver is to be executed, and wherein the at least one segmented region provides a second sensory indication of where at least one other part of the maneuver is to be executed, to form at least the portion of the visual pattern of the textile product.

In accordance with an embodiment of the present disclosure, a first combination of the stitch indicators and the segmented regions cooperate to form at least the portion of the visual pattern of the first side of the textile product. In addition, the first combination of the stitch indicators and the segmented regions cooperate to form at least the portion of the visual pattern of the second side of the textile product. The visual pattern of the first side of the textile product may be visually distinct from the visual pattern of the second side of the textile product. Also, the visual pattern of the first side of the textile product may correspond to the visual pattern of the second side of the textile product.

In another embodiment of the present disclosure, the first sensory indication of the at least one stitch indicator may be a visual indicator. In addition, the first sensory indication of the at least one stitch indicator may be a tactile indicator. Also, the second sensory indication of the at least one segmented region may be a visual indicator. The second sensory indication of the at least one segmented region may also be a tactile indicator.

In one embodiment, the maneuver may be at least one stitch. In addition, the stitch may be a plurality of movements in a sequence. The at least one part of the maneuver may be one of the plurality of movements in the sequence. In addition, the at least one other part of the maneuver may be one of the plurality of movements in the sequence.

At least one individual stitch indicator may correspond to an end of a segmented region and a beginning of another segmented region. Also, a pair of stitch indicators may correspond to a beginning of a segmented region and an end of the segmented region.

In another embodiment, the at least one stitch indicator is structured to be removed after at least the portion of the visual pattern of the textile product is formed. In addition, at least one stitch indicator may be configured to change form upon an application of heat. Similarly, at least one segmented region may be configured to change form upon an application of heat.

Alternatively, at least one stitch indicator may be configured to join at least one other stitch indicator. The at least two joined stitch indicators may be configured to contribute to at least a portion of an object.

In yet another embodiment, at least one stitch indicator couples two segmented regions together. Additionally, at least one stitch indicator may be an area of transition between two integrally formed segmented regions. The at least one segmented region may be configured to provide an indication of a type of stitch to perform with the flexible filament. In addition, the at least one stitch indicator may be configured to provide an indication of a type of stitch to perform with the flexible filament.

Additionally, at least one or more of the plurality of segmented regions or at least one or more of the plurality of stitch indicators is configured to provide an indication of a length of the flexible filament to use to form the maneuver. The material may include at least one from among yarn, thread, ribbon, rope, string, wool, embroidery thread, floss, straw, rubber thread, rubber yarn, fishing line, cloth, felt, acrylic, microfiber acrylic, rayon, rayon from bamboo, polyamide, nylon, cotton, polyester, cupro, cashmere, mohair, silk, merino, stainless steel, suede, velvet, acetate, filament silk, angora, plastic, glow-in-the-dark material, cord, paper, or any other long continuous flexible material.

In accordance with another embodiment, a method of manufacturing a flexible filament that is used to form at least a part of a textile product is disclosed. The method of manufacturing includes forming a length of textile material configured to be used in forming at least the part of the textile product to have a visual pattern on at least one of a first side or a second side of the textile product and forming a plurality of stitch indicators on the material to separate the material into a plurality of segmented regions, at least one of the stitch indicators or segmented regions forming at least a portion of the visual pattern on the at least one of the first side or the second side of the textile product. The at least one segmented region may be formed to have a first length that corresponds to a width of at least a portion of at least one maneuver to be formed.

The method may further include forming the at least one stitch indicator to be a large stitch indicator that is larger than a width of at least a portion of at least one stitch, the large stitch indicator configured to resist movement of the segmented region that precedes the large stitch indicator. The stitch indicators and the segmented regions may be configured to form a number of rows having a number of stitches that correspond to a width and a length of at least the portion of the visual pattern. In addition, the flexible filament may be configured to accommodate a plurality of maneuvers, wherein at least one pair of the stitch indicators are configured to indicate where to manually form at least one of the maneuvers, to contribute to at least the part of the visual appearance of the textile product. At least one of the stitch indicators may be configured to indicate a type of stitch to perform with at least one respective segmented region. Also, at least one of the segmented regions may be configured to indicate at least one type of maneuver and a length of the flexible filament to use to perform the at least one type of maneuver.

In accordance with yet another embodiment of the present disclosure, a flexible filament for forming a textile product is provided. The flexible filament includes, a length of material configured to be used in forming the textile product to have at least a portion of a visual pattern on at least one of a first side or a second side of the textile product. The material includes a plurality of stitch indicators formed on the material to separate the material into a plurality of segmented regions, at least one of the stitch indicators or the segmented regions forming at least the portion of the visual pattern on the at least one of the first side or the second side of the textile product. Additionally, at least one pair of stitch indicators may provide a sensory indication of where a stitch is to be executed. Also, the stitch indicators are spaced at intervals on the material. A pair of stitch indicators may be configured to correspond to a beginning of a segmented region and an end of the segmented region.

The present disclosure also provides that at least one of the stitch indicators may be structured to be removed after at least a portion of the textile product is formed with the visual pattern. At least one of the stitch indicators may be configured to change form upon an application of heat. Additionally, at least one of the segmented regions may be configured to change form upon an application of heat. In addition, at least one of the segmented regions may be configured to provide an indication of at least one type of stitch to be formed with the flexible filament. At least one of the stitch indicators may be configured to provide an indication of at least one type of stitch to be formed with the flexible filament.

Additionally, a method of manufacturing a flexible filament that is used to form a textile product by stitching is disclosed in accordance with the present disclosure. The method of manufacturing includes forming a length of textile material configured to be used in forming the textile product, forming a plurality of stitch indicators on the material to separate the material into a plurality of segmented regions, at least one of the stitch indicators or segmented regions forming a visual pattern on at least one side of the textile product, and forming at least one of the plurality of segmented regions to have a length that corresponds to a width of at least a portion of at least one stitch to be formed by the stitching. The method may further include forming at least one of the stitch indicators to be a large stitch indicator that is larger than the width of the stitch, the large stitch indicator configured to resist movement of the segmented region that precedes the large stitch indicator.

In accordance with another embodiment of the present disclosure, a textile product is provided that is formed by using a flexible filament having a plurality of stitch indicators formed on a length of material to separate the material into a plurality of segmented regions, at least one of the stitch indicators or the segmented regions forming at least a portion of a visual pattern on at least one side of the textile product, and by manually forming a plurality of stitches with the flexible filament using the stitch indicators as a sensory indication of where to position the stitches to form at least the portion of the visual pattern. The at least one of the stitch indicators or the segmented regions may indicate a type of stitch to perform. In addition, at least one or more of the segmented regions may indicate at least one type of at least one stitch to form, and a length of the flexible filament to use to form the at least one stitch.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings.

DETAILED DESCRIPTION

Figure 1A:
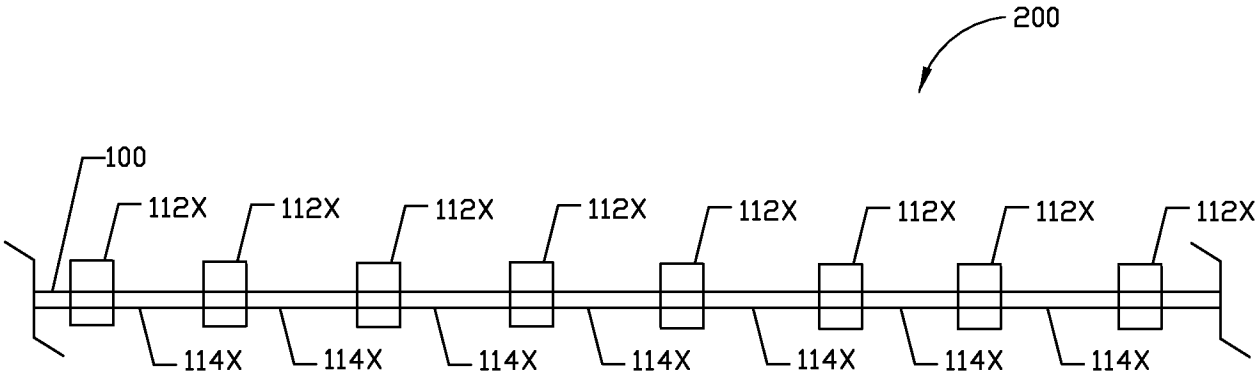
FIGS. 1A and 1B are a side view and a cross-sectional view, respectively, of a flexible filament having segmented regions arranged between stitch indicators according to one embodiment of the present disclosure.

In the following description, certain specific details are set forth in order to provide a thorough understanding of various embodiments of the disclosure. However, one skilled in the art will understand that the disclosure may be practiced without these specific details. In other instances, well-known structures associated with knitting have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

In the drawings, identical reference numbers identify similar elements or acts. The size and relative positions of elements in the drawings are not necessarily drawn to scale. The letter "X" is included in many of the reference numbers in order to emphasize the variability of different forms each particular feature may take.

Referring initially to FIG. 1A, a side view of a flexible filament 200 formed in accordance with the present disclosure is illustrated. The filament 200 includes a length of material 100 having a plurality of stitch indicators 112X that visually divide the length of material 100 into a plurality of segmented regions 114X. In the Figure, rectangular boxes highlight the areas of the stitch indicators 112X. The stitch indicators and segmented regions correspond to a predetermined visual pattern on a textile product that a user forms with the flexible filament 200 by performing a preselected sequence of actions. The stitch indicators 112X and the segmented regions 114X provide sensory indications that specify information to guide a user in forming the textile product.

The visual design is preselected by a manufacturer before assembling the flexible filament 200 so that that the stitch indicators and segmented regions are appropriately sized and shaped to cooperate in forming the visual design in the finished product. The manufacturer may also preselect the sequence of actions that will form the visual design with the flexible filament. The sequences of actions include different methods of manipulating the length of material such as knitting, crocheting, weaving, macramé, tatting, embroidery, hooking, knotting, braiding, cross stitching, sewing, temari balls, basket weaving, latch hooking, beading, punch-needling, Tunisian crochet, Afghan Stitch, Tricot Crochet, Shepherd's Knitting, Hook Knitting, Railroad Knitting, rug hooking, and rug making, to name a few. The sequence of actions may include forming a part of a stitch, a complete stitch, a maneuver, a manipulation, a knot, a loop, a twist, a part of a braid, or any other movement that may be taken by the user to manually form the textile product.

In addition, the manufacturer may specify that the user should use a specific implement or implements to form the sequence of actions. For example, the manufacture may specify the use of knitting needles, a crochet hook, an Afghan hook, circular knitting needles, bobbins for weaving, a crotatting tool, double-pointed knitting needles, a dowel for macramé, a latch hook, a cross-stitch needle, a punch-needle, a shuttle for weaving, or a tatting needle, to name a few. When the sequence of actions is executed with a tool, an active loop refers to a previously formed loop that is held on the tool until a subsequent sequence of actions transfers the loop off of the tool.

Throughout this disclosure, the terms "stitch," "manipulation," "maneuver," and variations thereof refer to a particular sequence of actions or a portion of a particular sequence of actions. In one embodiment, the textile product may be formed of a plurality of interconnected stitches that are each formed by a specific sequence of actions. A single stitch is a complete sequence of actions with the flexible filament that involves looping, twisting, pulling, or otherwise moving the flexible filament around itself or another object. The user performs the sequence of actions to incorporate a portion of the flexible filament that is free or not yet formed into the textile product with the portion of the textile product that has already been formed.

For example, a knit stitch is a well-known type of stitch that is achieved through a particular sequence of actions executed by the user. Generally speaking, forming a loop with the free portion of the length of material and pulling the loop through a previously formed loop forms a knit stitch. The particulars of forming knit stitches are well known in the art and will not be described in detail herein.

The length of material may be a length of yarn, such as a long continuous length of interlocking fibers. Alternatively, the length of material 100 may be thread, ribbon, rope, string, wool, embroidery thread, floss, straw, rubber thread, yarn, rubber yarn, fishing line, cloth, felt, acrylic, micro-fiber acrylic, rayon, rayon from bamboo, polyamide, nylon, cotton, polyester, cupro, cashmere, mohair, silk, merino, stainless steel, suede, velvet, acetate, filament silk, angora, plastic, glow-in-the-dark material, cord, paper, or any other long continuous flexible material. In addition, the length of material may have a circular cross-section. However, other cross-sections may be formed.

Positions and physical characteristics of the stitch indicators 112X and the segmented regions 114X depend on the pre-determined visual pattern to be formed on the textile product. In addition, the dimensions for the length of material 100, the stitch indicators 112X, and the segmented regions 114X are variable and depend upon the specific sequence of actions for which the flexible filament 200 is designed.

The stitch indicators 112X may be a variety of lengths, widths, textures, materials, objects, or colors. The stitch indicators 112X may also have additional decorative or aesthetic components, which include but are not limited to fringe, beads, pom-poms, streamers, threads, wood, or tassels. Ideally, the additions will not affect how a user performs the manipulations to form textile product.

The stitch indicators 112X may be tactile indicators that form one of the elements of the visual pattern or design on the textile product. For example, the stitch indicators may be a plurality of colored beads that form an image on one side of the textile product and the segmented regions form a corresponding image on the another side of the textile product. Advantageously, the stitch indicators 112X may cooperate with each other or with the segmented regions 114X to form the visual pattern or selected design without requiring transitions between different spools of yarn at each color change.

The stitch indicators 112X are in one embodiment configured to have a plurality of functions. For example, one or more stitch indicators may indicate sensory instructions, i.e., the subsequent action to take with regards to the flexible filament. The sensory indication may be visual or tactile such that a size, color, or other sensory property provides the user with information. The color of a bead stitch indicator may define the action to perform, such as when to begin a stitch, when to end a stitch, a length of a stitch, a type of a stitch, or a portion of what type of stitch.

For example, the stitch indicators 112X may indicate what type of stitch to form with an adjacent segmented region. The stitch indicators 112X may indicate an amount of the length of material 100 and a number of subsequent stitch indicators and segmented regions to use to form a sequence of actions. By following instructions dictated by the stitch indicators and segmented regions, the user will form the textile product having the selected visual pattern. The final pattern will have stitch indicators in preselected positions that correspond with other stitch indicators and segmented regions to form the visual pattern. As the manipulation proceeds, the visual pattern will emerge. For example, if knitting a scarf, the pattern will emerge row by row.

In one embodiment, a pair of stitch indicators, such as stitch indicators 112X-1 and 112X-2, assists a user to form consistent stitches. The pair of stitch indicators 112X-1 and 112X-2 designates a beginning and an end of a segmented region 11X-1 that corresponds to an amount of the length of material 100 to use to form one sequence of actions, i.e., one purl stitch. More particularly, the first stitch indicator 112X-1 may indicate when to start the purl stitch and the second stitch indicator 112X-2 may indicate where to end the purl stitch.

A length of the segmented regions 114X may correspond to a sequence of actions or only a portion of a sequence of actions. For example, the portion of the sequence of actions may be to form a loop or a maneuver. The various segmented regions may all have the same material, texture, and color, or alternatively, the segmented regions may be different materials, different colors and different textures. In addition, the segmented regions 114X may be any length, width, color, texture, material, object, or shape, including, but not limited to wavy, zigzag, glittered, ribbed, and straight. The segmented regions 114X may have additional decorative or aesthetic components that are configured to not hinder the user from forming the sequences of actions with the segmented region 114X, such as a knit stitch. Variations of the segmented regions are described herein below.

Alternatively or additionally, the segmented regions 114X in one embodiment have a plurality of functions. For example, the segmented region 114X-1 may provide a sensory instruction of a subsequent action in the sequence of actions to be taken by the user to form the textile product. The sensory instruction may be a visual indication or a tactile indication of an amount of the length of material 100 to use or a location to begin or end the action. In addition, the segmented region and the corresponding stitch indicators may cooperate to instruct the user what action to execute. In one embodiment, the length of the segmented region corresponds to a single stitch; however, a series of segmented regions may also correspond to a single stitch. More particularly, a corresponding sequence of actions that form the stitch may utilize a single segmented region or a plurality of sequential segmented regions.

Figure 1B:
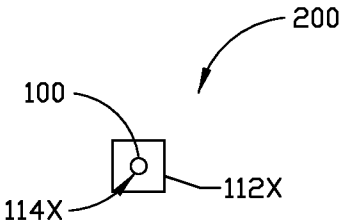

FIG. 1B illustrates a cross-section of the flexible filament 200 of FIG. 1. The stitch indicator 112X shown here is highlighted with a rectangular box around the segmented region 114X of the length of material 100. As described above, the stitch indicator may be a variety of sizes and shapes. Several embodiments of the stitch indicators will be described herein below. Unless otherwise specified in the instructions, the length of material 100, stitch indicators 112, and the segmented regions 114 are used sequentially, starting at a beginning 101 of the length of material 100, and ending at a terminal end 180 (not shown in this Figure).

Each flexible filament may have a set of instructions related to the specific visual design to be formed. The instructions may be printed on a sheet of paper or on packaging containing the flexible filament. Alternatively, the instructions may be downloadable from a manufacturer's website. Regardless of the manner of presentation, the instructions will include information regarding what sequence of actions to perform and in what order. For example, the flexible filament may be intended to form alternating rows of knit and purl stitches.

As will be explained, the instructions will have varying levels of complexity that may vary from simply indicating what type of sequence of actions to perform to listing different stitches to form in association with specific types of stitch indicators or segmented regions. The instructions may also include a description of the size, diameter, or length of the tool to create the visual design. For example, if knitting is the method of manipulation, the instructions may describe the gauge of the knitting needle to use.

The complexity of the instructions is related to the complexity of the visual pattern and the sequence of actions associated with forming the visual pattern. The instructions may include an image, a picture, a graph, a grid, a pattern, or other visual information about how to form the textile product. In one embodiment, the instructions include descriptions of different sequences of actions that are associated with different sensory stitch indicators. Additionally or alternatively, the instructions include descriptions of what type or how many loops that will be formed or other sequence of actions to be taken with different sensory segmented regions. The instructions may be correlated to a color, a texture, a shape, a size, or other distinguishing characteristic of the stitch indicator or segmented region.

In another embodiment, the instruction will differentiate between features of the flexible filament that are stitch indicators and features that are simply decorative extensions from a segmented region. For example, if one of the segmented regions includes fringe or a tassel, then the instructions can clarify that these features are not stitch indicators. Alternatively, the stitch indicators in this embodiment may have a significantly different appearance, such as a bead, so that the user is not confused about what element of the flexible filament is the stitch indicator.

Alternatively, the characteristic of the stitch indicator will not relate to the type of stitch or sequence of actions. In this case the instructions will state that all stitches to be formed are a single type of stitch, like a knit stitch, or that alternating rows of knit and purl stitch are to be formed. Additionally, the stitch indicator is an indication of where to begin or end a row of sequences of actions (see FIG. 25), or simply where to begin or end a single stitch or sequence of actions. For example, the stitch indicator may mark the end of the prior segmented region and the beginning of the next segmented region.

Figure 2A:
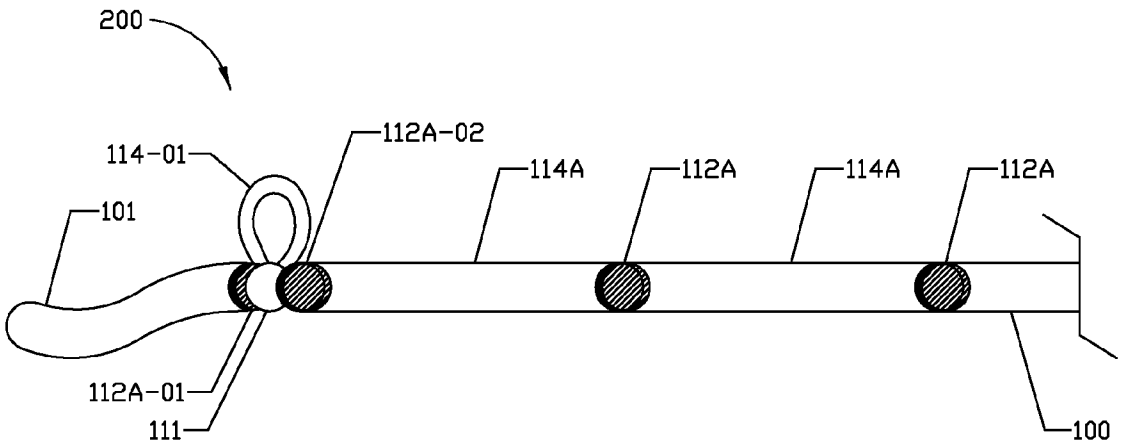
FIGS. 2A and 2B are a side view and a cross-sectional view, respectively, of an end portion of flexible filament with an initial loop having segmented regions arranged between stitch indicators according to an embodiment of the present disclosure.
Figure 2B:
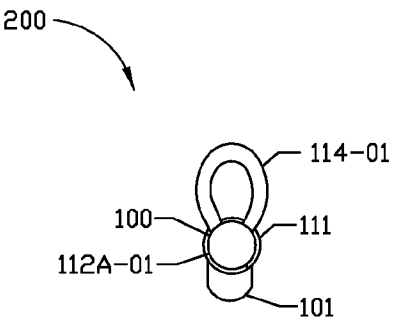

FIGS. 2A and 2B are a side view and a cross-sectional view, respectively, of a beginning or an initial loop formed from the length of material 100 on the flexible filament 200 in accordance with an alternative embodiment of the present disclosure. The initial loop is formed by the user from one of the segmented regions 114-01 that is located between the first and second stitch indicators 112A-01 and 112A-02 of the flexible filament 200. The segmented region 114-01 extends from a securing factor 111, which may be a slip knot, a tie, a previous loop, or other object to securely hold a loop of the flexible filament 200. Also, a beginning end 101 of the length of material 100 extends away from the securing factor 111.

The user may first form the securing factor 111 as a slip knot at the first stitch indicator 112A-01 and then pull the segmented region 114-01 through the securing factor 111 until the second stitch indicator 112A-02 meets the securing factor 111. However, the securing factor 111 may be formed in any location that is suitable for the preselected textile product. More particularly, the type of securing factor 111 may depend on the sequence of actions intended for the textile product.

Alternatively, the securing factor 111 and initial loop of the segmented region 114-01 may be formed by the manipulator prior to purchase by the user. In this embodiment, the securing factor 111 may represent a first stitch indicator indicating, for example, a type of stitch to form with the subsequent segmented region or regions. For example, if the sequence of actions is a knit stitch, the securing factors will correspond to a prior row of stitches that are held on a knitting needle. Alternatively, the securing factors may not be an integrally formed part of the flexible filament of this embodiment, but instead may be components of a loom used for weaving (See FIG. 25).

In this embodiment, the stitch indicators 112A take the form of a dot stitch indicator and the segmented regions 114A are smooth or otherwise void of texture. The dot may be a visual dot, i.e., a change of color or it may be a small tactile variation on the length of material 100, such as a plastic bump. In this embodiment, the stitch indicators 112A are evenly spaced, forming equally sized segmented regions along the length of material 100. As will be shown below, the stitch indicators may form segmented regions of various lengths that correspond to the visual design.

Figure 3A:
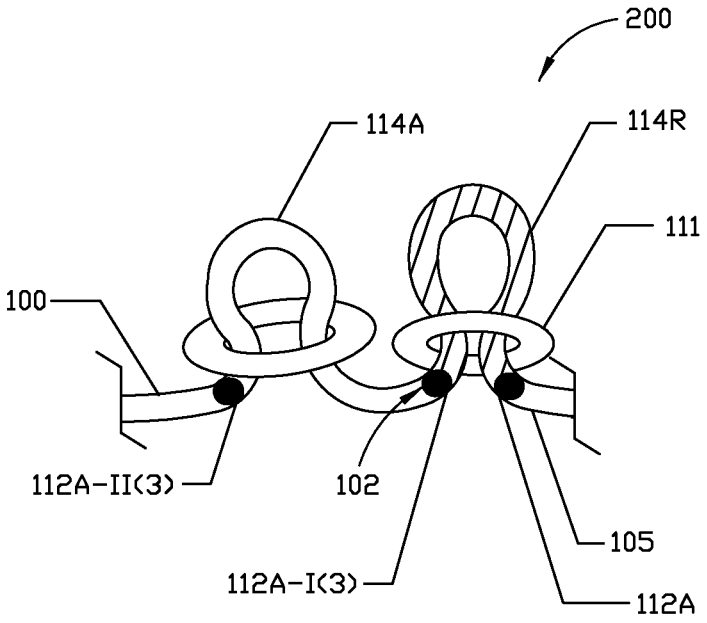
FIGS. 3A and 3B illustrate a flexible filament drawn through securing factors.
Figure 3B:
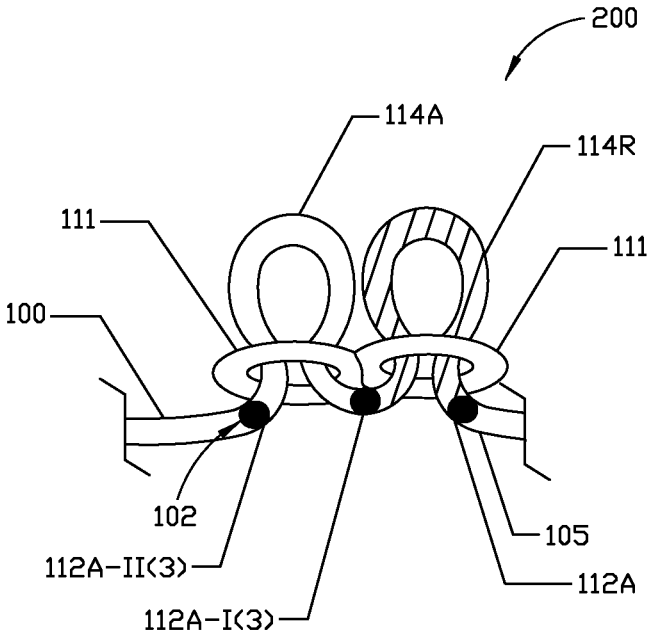

FIGS. 3A and 3B illustrate the stitch indicators 112 and the segmented regions 114 cooperating to form the sequences of actions to form a stitch. In this embodiment, the flexible filament 200 is being manipulated from right to left, which as is a common practice in knitting and crochet. The stitch indicators 112A, 112A-I(3), and 112A-II(3) are illustrated as a dot or color variation on the length of material 100. The segmented regions 114A and 114R are different textures or different colors. The first stitch indicator 112A represents the beginning of the segmented region 114R and the second stitch indicator 112A-I(3) represents the end of the segmented region 114R. The second stitch indicator 112A-I(3) represents the beginning of the next segmented region 114A, the end of which is represented by the third stitch indicator 112A-II(3).

In FIG. 3A, the second stitch indicator 112A-I(3) also represents a point of emergence 102 of the length of material 100 from a securing factor 111. The point of emergence 102 represents a free end of the length of material that extends from a work in progress 105, or in other words a transition from the already manipulated textile product and the remaining free length of material 100. The free length of material may be referred to as a workable portion that will be manipulated in the future to form a part of the textile product. For example, if the flexible filament was directed to creating a scarf, the work in progress 105 would be the part of the scarf that has been formed at a particular point in time. Any remaining length of material would be the free end or the workable portion of the length of material.

In one embodiment, the second stitch indicator 112A-I(3) is in contact with the securing factor 111. However, the second stitch indicator 112A-I(3) may not abut the securing factor 111.

FIG. 3A illustrates a result of executing a selected sequence of actions, such knitting or crocheting. In this embodiment, the selected sequence of actions is to form a single loop. Only a single segmented region is used for each loop, which means the point of emergence 102 will correspond to the second stitch indicator 112A-I(3). The second stitch indicator 112A-I(3) is adjacent both securing factors 111. As mentioned above, the stitch indicators may be or may not be in contact with the securing factor 111.

In FIG. 3B, the length of material 100, which was the free end in FIG. 3A, i.e., the segmented region 114A, has been looped and pulled through the securing factor 111 adjacent to the securing factor 111 securing the segmented region 114R. At this point, the third stitch indicator 112A-II(3) is the point of emergence 102. The stitch indicators may provide the user with a guide of how to form consistent stitches so that the desired pattern emerges.

Figure 4:
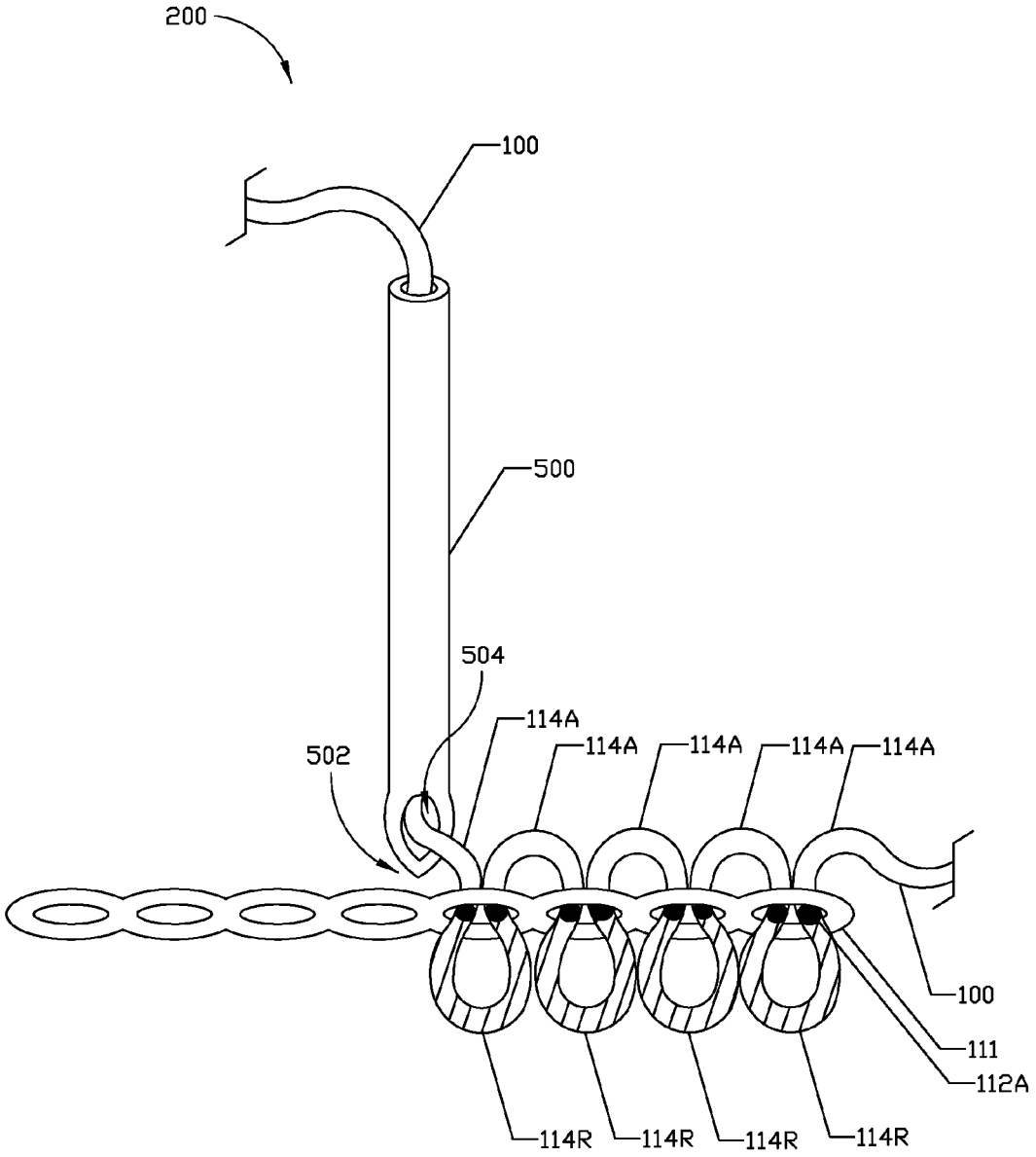
FIG. 4 illustrates a flexible filament being manipulated by a punch needle according to one embodiment of the present disclosure.

FIG. 4 illustrates an alternative embodiment of the flexible filament 200 having segmented regions of alternating appearance that are formed into the final product using a punch needle 500. A plurality of securing factors 111 are illustrated and may correspond to a previous sequence of actions where the securing factors 111 are a series of connected rings or loops, preferably in a linear arrangement. Securing factors 111 can also comprise of a fabric through which the punch needle or other tool can pierce through. In one embodiment, these securing factors 111 are portions of loops comprised of segmented regions from either the same or a different length of material.

In addition, the plurality of stitch indicators 112A divide the length of material 100 into a plurality of connected alternating segmented regions 114A, and 114R. The segmented regions are different in that they may be a plurality of colors, textures, or a combination of both.

The punch needle 500 has a sharp end 502 that can punch through fabric or other firm material. In addition, the punch needle 500 has a hole 504 at that same end through which the length of material 100 is threaded. The punch needle 500 is punched through a first side of the fabric, i.e., the securing factors 111, and pulled back to the first side of the fabric. After the punching action is complete, the length of material associated with that punch remains coupled to the fabric, i.e., the stitch indicators are touching the respective securing factor 111.

In this embodiment, the segmented regions 114R are all on a second side of the fabric. As the punch needle 500 is punched through the fabric, the pattern of the final textile product is formed with the plain segmented regions 114A on the first side of the fabric and the diagonally textured segmented regions 114R on the second side. Also, in this embodiment, the stitch indicators 112A are intended to touch a respective one of the plurality of securing factors 111 through which an associated segmented region has been punched.

The punch needle 500 and fabric securing factors 111 may be used to form a rug or embroidery, such as Japanese punch embroidery. In this embodiment, if the stitch indicators are appropriately aligned with the fabric securing factor 111, then every plain segmented region will be on one side of the rug, and every diagonal segmented region will be on the other side of the rug. Therefore, the plain segmented regions 114A will create a first design, and the diagonal segmented regions 114R will create a different design.

Figure 5:
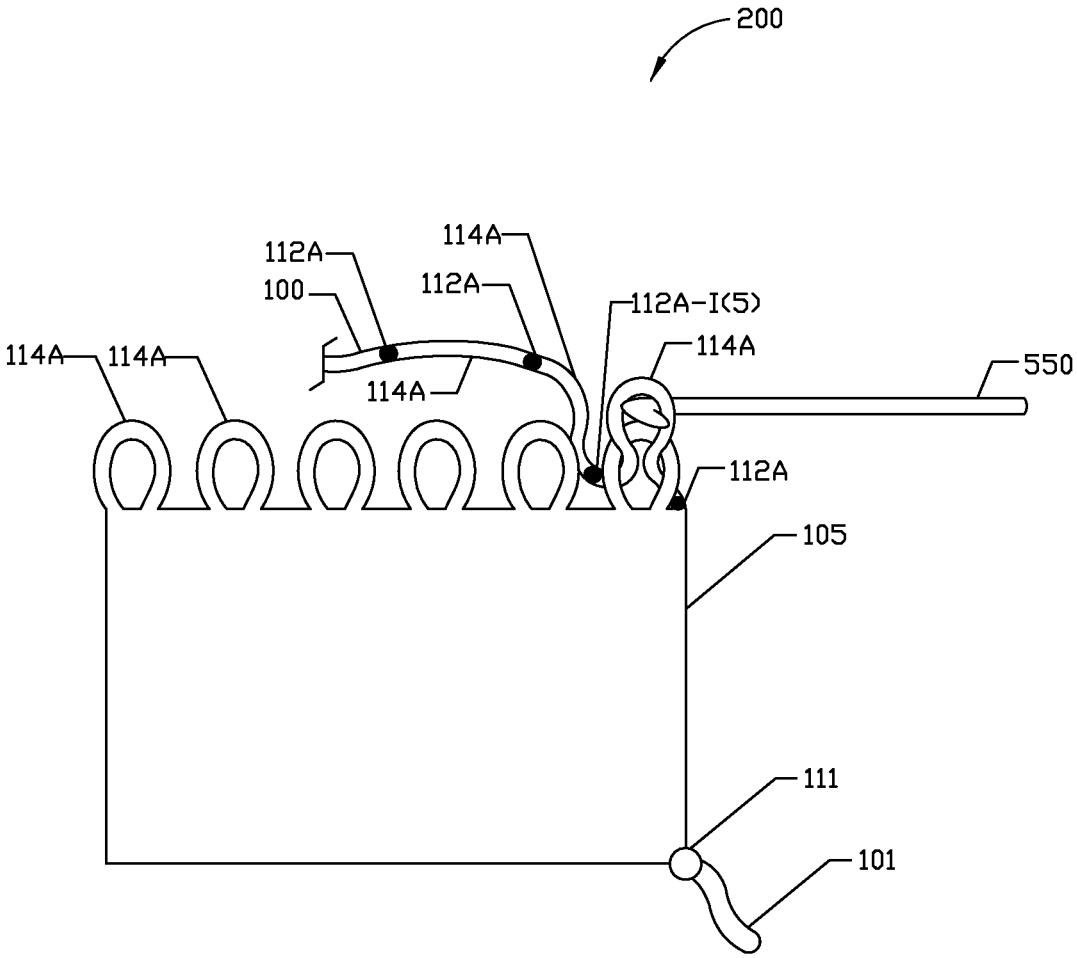
FIG. 5 illustrates a flexible filament being crocheted with a crochet hook in accordance with another embodiment of the present disclosure.

FIG. 5 illustrates a work in progress 105, where the length of material 100 is crocheted with a crochet hook 550. This length of material 100 of flexible filament 200 includes the stitch indicators 112A and the segmented regions 114A. In this embodiment, the stitch indicators 112A are visual dot indicators, such as a change in color, or a thin tactile indicator that is coplanar with the length of material 100. The stitch indicators 112A indicate a beginning of one segmented region and an end of a previous segmented region.

In this embodiment, each dot stitch indicator 112A marks the end of each complete sequence of actions to make a crochet slip stitch. Each crochet stitch is formed of a single segmented region 114A hooked by the crochet hook 550 and pulled through a prior crochet stitch loop 114A on the work in progress 105. The dot stitch indicator 112A-I(5) indicates the point of emergence of the free end of the length of material 100 yet to be crocheted.

While the work in progress 105 is illustrated as having a square shape, the work in progress 105 can take any shape, such as circular, semi-circular, crescent-shaped, spherical, spiral, rectangular, tubular, trapezoidal, polygonal, pentagonal, octagonal, hexagonal, decagonal, triangular, oval-shaped, wavy, sock-shaped, hat-shaped, clothes-shaped, heart-shaped, or star shaped. In one embodiment, the work in progress 105 is of a sequence of only crocheting actions, only knitting actions, or other actions suited to just one type of yarn craft. However, the textile product may be formed from a combination of sequences, such as a product incorporating knit and crochet stitches and braiding.

Figure 6:
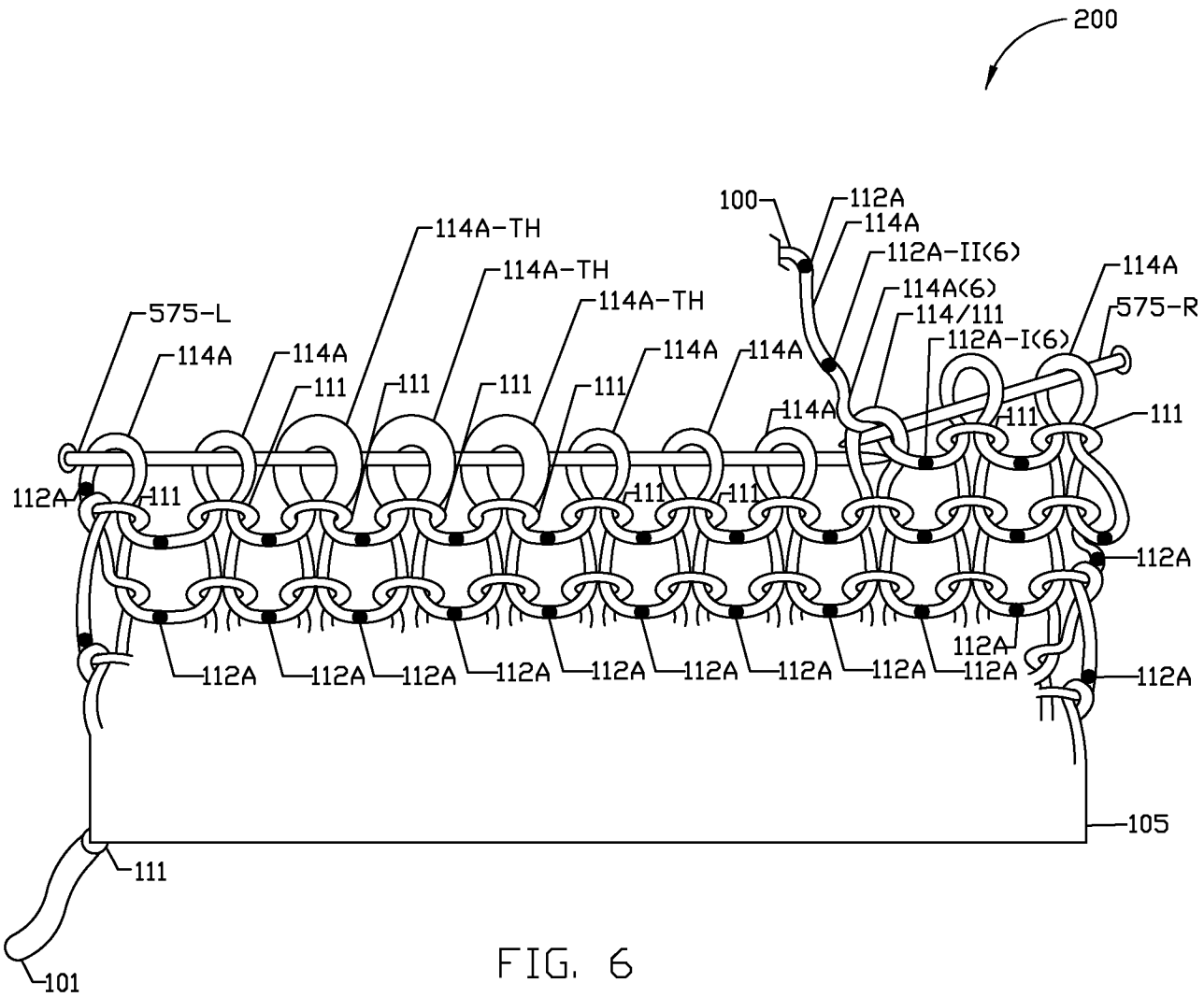
FIG. 6 illustrates positions of knitting needles and a flexible filament having stitch indicators and segmented regions while forming a textile product.

FIG. 6 illustrates the beginning end 101 of the length of material 100 of flexible filament 200, extending from the work in progress 105 that is knitted with a right-hand knitting needle 575-R and a left-hand knitting needle 575-L. In this embodiment, a plurality of purl stitches are illustrated, which are a standard stitch in the art of knitting.

The work in progress 105 includes a plurality of interconnected rows of purl stitches that form a first and a second side of the work in progress. In this embodiment, the plurality of stitch indicators 112A are all configured to be on the first side of the work in progress 105.

A dot stitch indicator 112A-I(6) marks a beginning of the next segmented region 114A(6) to be formed into a loop with the right-hand knitting needle 575-R. The user forms the loop with the segmented region 114A(6) with the right-hand knitting needle 575-R and pulls the loop through the previously formed segmented region 114. By this previously formed segmented region being utilized to secure the loop made with securing region 114A(6), it becomes a securing factor 111. Therefore, it is labeled as 114/111. The flexible filament includes three segmented regions 114A-TH that are thicker than the other segmented regions 114A. The thickness of the segmented regions can vary depending on the ultimate design.

Figure 7:
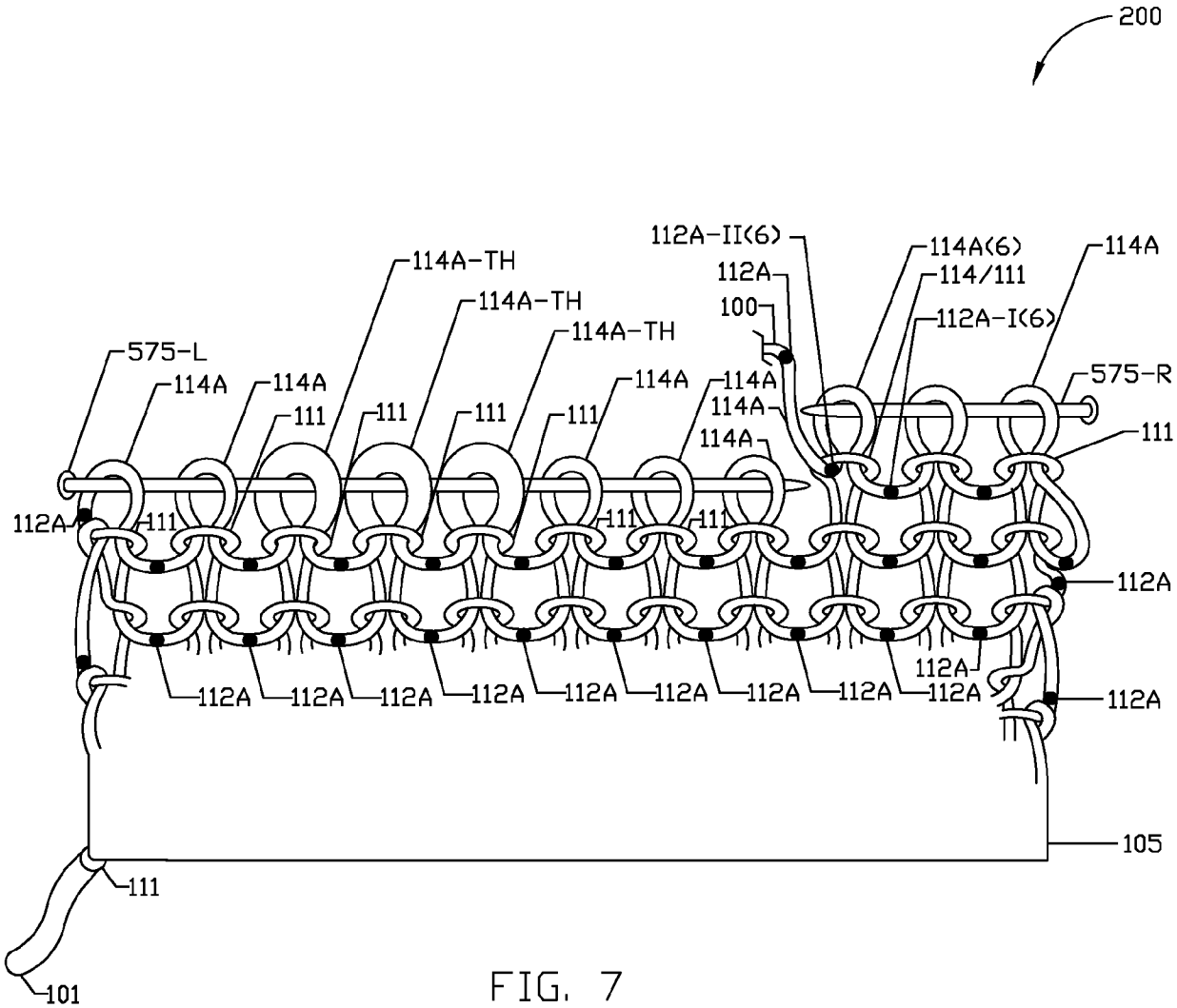
FIG. 7 illustrates a subsequent position of the flexible filament and knitting needles of FIG. 6.

FIG. 7 illustrates a position of the right-hand knitting needle 575-R and left-hand knitting needle 575-L after the purl stitch of FIG. 6 is completely formed. After drawing or pulling the segmented region 114A(6) through the securing factor 111 of the previously looped segmented region 114/111, the newly "purled" segmented region 114A(6) is then tightened or loosened by the user, so that dot stitch indicator 112A-II(6) abuts the securing factor 114/111. At this point, the dot stitch indicator 112A-II(6) is the point of emergence of the length of material 100 of flexible filament 200.

Originally, the securing factor 111 comprised of the segmented region 114 was associated with the left-hand knitting needle 575-L (see FIG. 6). However, after the purl stitch is completed with the segmented region 114A(6), the securing factor 114/111 slips off the left hand knitting needle and is associated with the right-hand knitting needle 575-R through the newest loop comprised of segmented region 114A(6).

The plurality of stitch indicators 112 in FIGS. 6 and 7 mark the end of one purl stitch and the beginning of the next purl stitch. This marking also indicates what amount of the length of material 100 should be used for each stitch, which also corresponds to the segmented regions 114A. Furthermore, it alerts the user when one of the purl stitches is out of place or shifted in some way. The user may easily adjust tension of the length of material to ensure the stitch indicators are arranged in the intended position.

Figure 8A:
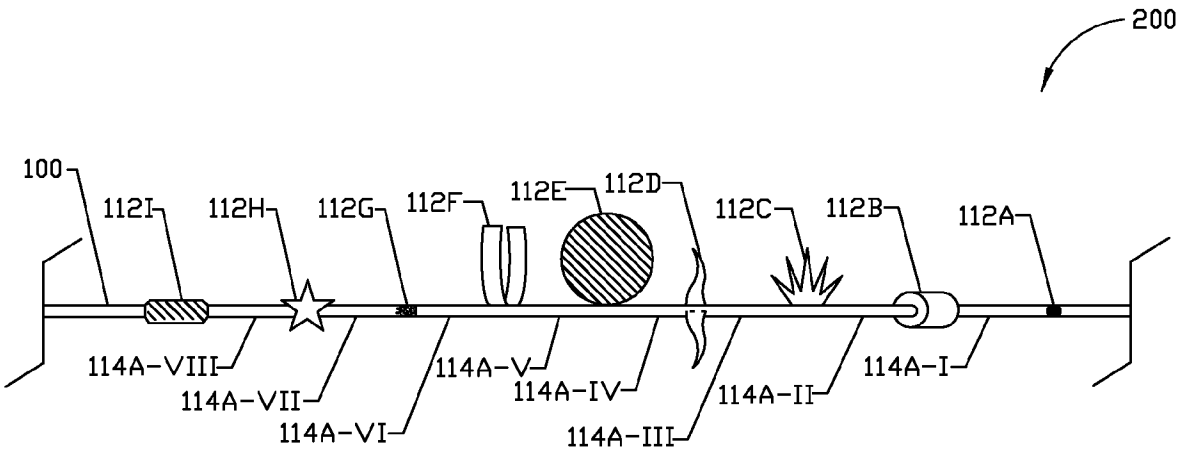
FIGS. 8A and 8B illustrate a side view and a cross-sectional view, respectively, of a flexible filament having a plurality of different stitch indicators.
Figure 8B:
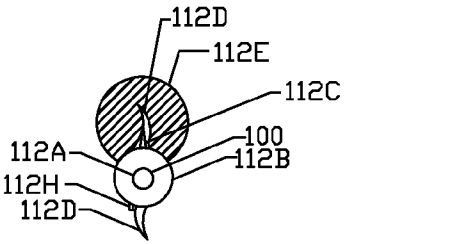

FIGS. 8A and 8B show a side view and a cross-sectional view, respectively, of a length of material 100 of flexible filament 200, having a plurality of different stitch indicators 112A through 112I and a plurality of segmented regions 114A-I through 114A-VIII. The stitch indicators include a dot stitch indicator 112A, a bead stitch indicator 112B, a fringe stitch indicator 112C, a removable thread stitch indicator 112D, a pom-pom stitch indicator 112E, a fabric strip stitch indicator 112F, a sparkle stitch indicator 112G, a star stitch indicator 112H, and a felt stitch indicator 112I. All of these stitch indicators 112 are configured to attach or couple to one length of material 100. This list of stitch indicators is not an exhaustive list, and other stitch indicators may be used that are of a variety of size, shapes, textures, materials, and colors.

The removable thread stitch indicator 112D extends through the length of material, entering one side of the length of material 100 and exiting from the other side. The removable thread stitch indicator 112D is not held in place by a knot or other securing mechanism. Once the segmented regions 114A-III and 114A-IV have been manipulated by the user according to the sequence of actions to form at least a portion of the textile product, the removable thread stitch indicator 112D may be removed by simply pulling on one of the ends. Such stitch indicators may be useful to indicate where a stitch is to be formed when the final textile product does not call for a visible stitch indicator at that specific position in the final design.

If the entire length of material 100 had only removable thread stitch indicators, the final textile product would form the predetermined design without any stitch indicators 112. The removable thread stitch indicators 112D and any other type of removable stitch indicators 112 are useful when the presence of stitch indicators 112 interferes with the desired appearance of the final product.

Alternatively, one of the stitch indicators may be fusible or otherwise affected by heat. For example, bead stitch indicator 112B could be a fuse bead. Fuse beads may be used as stitch indicators on a length of material. The user may then warm or otherwise heat the completed textile product to cause the fuse beads to melt and form the visual design.

As described above, an individual stitch indicator may simply mark an end of one segmented region and a beginning of the next segmented region. However, the individual stitch indicator may alternatively or additionally instruct a user what type of sequence of actions to perform, such as a knit stitch or a purl stitch, in order to create the visual design on the textile product. In this embodiment, the instructions may provide a key that describes the type of sequence of actions associated with each stitch indicator. The distinction may be simply by color if all of the stitch indicators are the same form or the distinction may be by texture, size, shape, or any other distinguishable characteristic.

In this embodiment, the dot stitch indicators 112A indicate a single crochet stitch is to follow the dot stitch indicator. The single crochet stitch is formed with two loops. The fringe stitch indicators 112C indicate a double crochet stitch is to follow fringe stitch indicators, which is a three-loop sequence of actions. The fabric strip stitch indicators 112F indicate a crochet slip stitch is to proceed the fabric strip stitch indicator, which is a single-loop stitch. The sparkle stitch indicators 112G indicate a single crochet is to proceed the sparkle stitch indicator, which is a two-loop sequence of actions. The felt stitch indicators 112I also indicate a single crochet stitch is to proceed it. In this embodiment, one segmented region is intended to comprise one loop pulled through a securing factor. Additional instructions may be associated with the other stitch indicators.

The sequence of actions for the length of material 100 in FIG. 8 would start with dot stitch indicator 112A. The point of emergence and the preceding securing factor 111 is not illustrated in this figure, but will be referred to in the following. The user would form a single crochet stitch in accordance with the instructions for the dot stitch indicator. In this embodiment, the single crochet stitch is a two-loop stitch and would use the segmented region 114A-I and the segmented region 114A-II. In an alternative embodiment, the two loops may be formed by the segmented region 114A-I if manufactured to be long enough to support the two loops of the single crochet stitch.

When the single crochet stitch is formed from the segmented regions 114A-I and 114A-II, the securing factor will abut the fringe stitch indicator 112C. The fringe stitch indicator 112C indicates the next stitch, the double crochet stitch. A first loop is formed from the segmented region 114A-III, a second loop is formed from the segmented region 114A-IV, and a third loop is formed from the segmented region 114A-V. The fabric stitch indicator 112F will abut the securing factor associated with the double crochet stitch.

The next stitch in the sequence is dictated by the fabric stitch indicator 112F and is a slip stitch, which is a single-loop stitch. Therefore, the single loop is formed from the segmented region 114A-VI. The sparkle stitch indicator 112G marks the end of the single stitch and abuts the respective securing factor.

The next stitch in the sequence is dictated by the sparkle stitch indicator 112G that is a single crochet stitch, which is a two-loop stitch. A first loop is formed from the segmented region 114A-VII and a second loop is formed from the segmented region 114A-VIII. The felt stitch indicator 112I marks the end of the stitch and abuts the respective securing factor.

Additionally, the type of stitch indicator or segmented region may indicate which type of sequence of actions to perform preceding it, or involving it. For example, instructions could specify that before each bead stitch indicator, a purl stitch is to be formed. In this case, the purl stitch would end with the bead stitch indicator.

Additionally, one stitch indicator may indicate which type of sequence of actions is to precede and follow it. For example, a sparkle stitch indicator might indicate that a purl stitch is to be made with the segmented region preceding it, and a knit stitch is to be made with the segmented region following it.

Alternatively, specific stitch indicators may indicate a sequence of stitches to execute while intermediate stitch indicators are simply for decoration. For example, the stitch indicators 112A and 112G may be the only instruction indicators. The remaining stitch indicators would be for indicating the placement of the steps of the sequence, and for decoration upon the stitches formed according to the instructions of 112A and 112G. An instruction may specify that after each certain stitch indicator 112, the user is to form a certain sequence. For example, after each sparkle stitch indicator 112G, the user must perform the sequence of a single crochet, a slip stitch, and a double crochet stitch.

Alternatively, the instructions may specify that a certain stitch indicator is the first instruction stitch indicator. The following stitch indicators may be meant to mark the placement of the steps of the stitch or sequence of stitches corresponding to that type of instruction stitch indicator. The type of these following stitch indicators would not matter to the actions being performed.

These instructions may also include that once the corresponding stitch or sequence of stitches is performed, it is the stitch indicator that marks the point of emergence which is the next instruction indicator, and so on and so forth. Therefore, looking at a length of flexible filament which is to be used with these instructions, a user would not necessarily know which stitch indicator(s) are the instruction stitch indicators, until the stitch or sequence of stitches immediately preceding that instruction stitch indicator are performed.

Advantageously, this flexible filament provides users with sensory instructions regarding how to create the desired textile product whose decorative stitch indicators add to the final design.

Figure 9A:
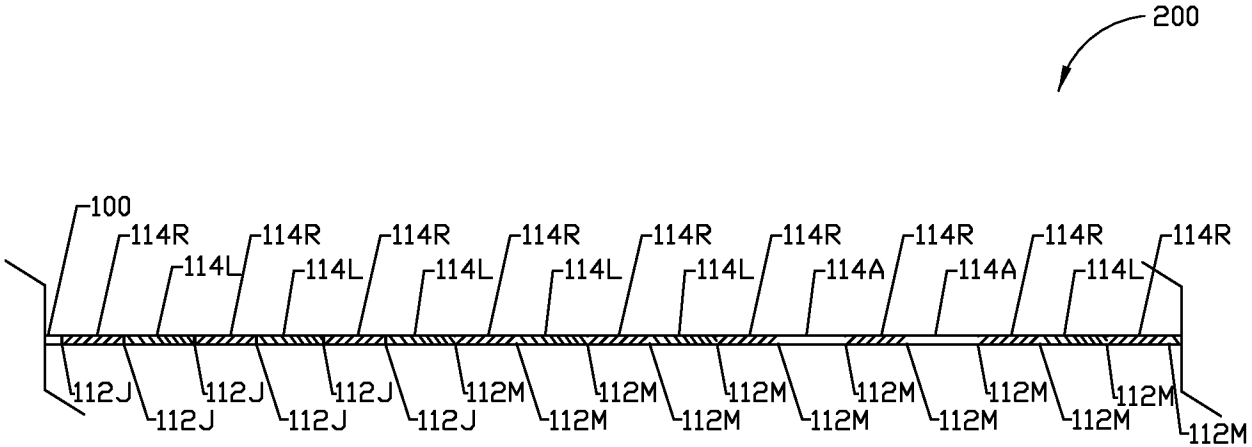
FIGS. 9A and 9B illustrate a side view and a cross-sectional view, respectively, of an alternative embodiment of stitch indicators and segmented regions on a flexible filament.
Figure 9B:
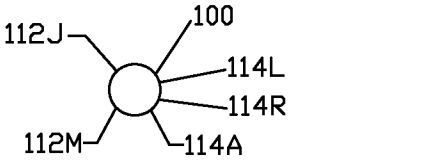

FIGS. 9A and 9B illustrate another embodiment of the flexible filament 200 having a length of material 100 that has a plurality of segmented regions 114A, 114L, 114R and a plurality of stitch indicators 112M, and 112J. The segmented regions include texture such that the segmented regions 114R are right-diagonal segmented regions and the segmented regions 114L are left-diagonal segments. The stitch indicators are connector stitch indicators 112J and transition stitch indicators 112M.

The transition stitch indicator 112M is not a tangible indicator, but rather a visual stitch indicator that is a transition between two segmented regions. The transition may be a point where the material changes color, texture, pattern, or other visual or tactile distinction. In this embodiment, the transition stitch indicator 112M is the point of transition from the right-tilting pattern of right-diagonal segmented region 114R to the left-tilting pattern of left-diagonal segmented regions 114L.

The connector stitch indicators 112J represent a physical union of two different materials or segmented regions. The connector stitch indicators may be joined with sewing, gluing, heat welding, or other secure connection. Ideally, the connection will withstand the pulling and tugging associated with knitting, crocheting, and other methods of manipulation.

Figure 10A:
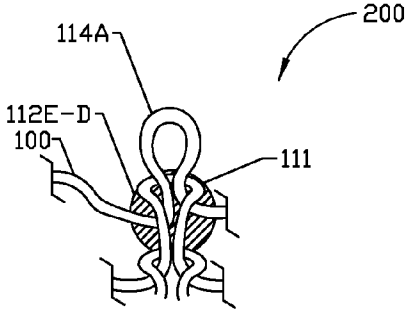
FIGS. 10A-10C illustrate a side view, another side view, and a back-side view, respectively, of positions of pom-pom stitch indicators and segmented regions on a flexible filament during a knitting process.
Figure 10B:
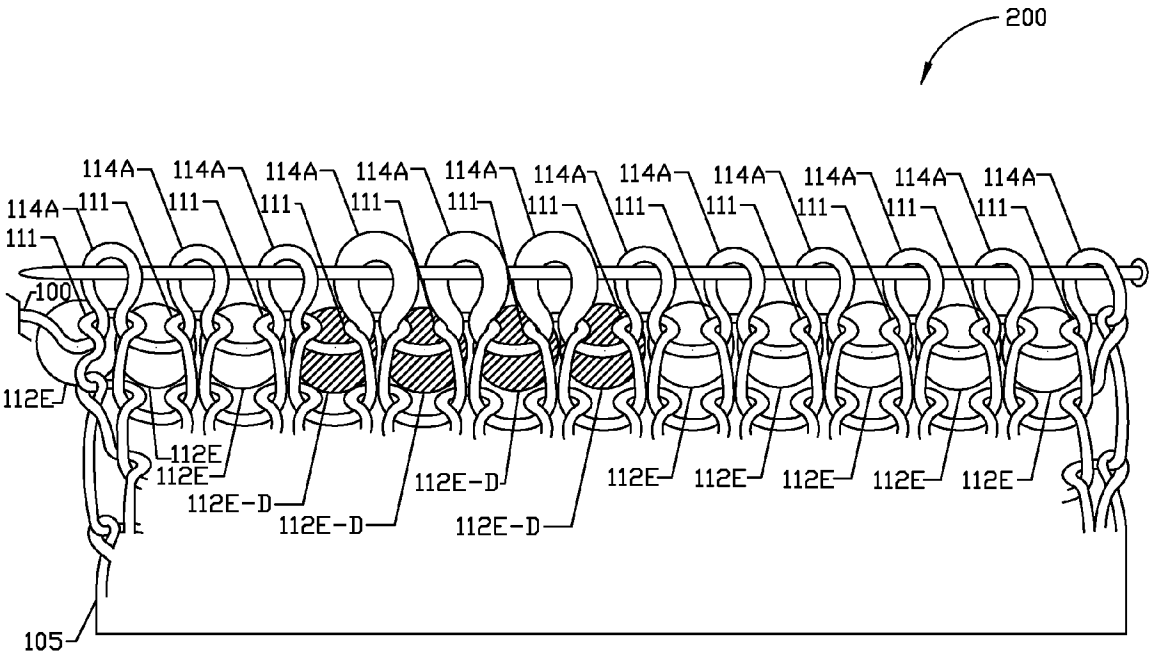
Figure 10C:
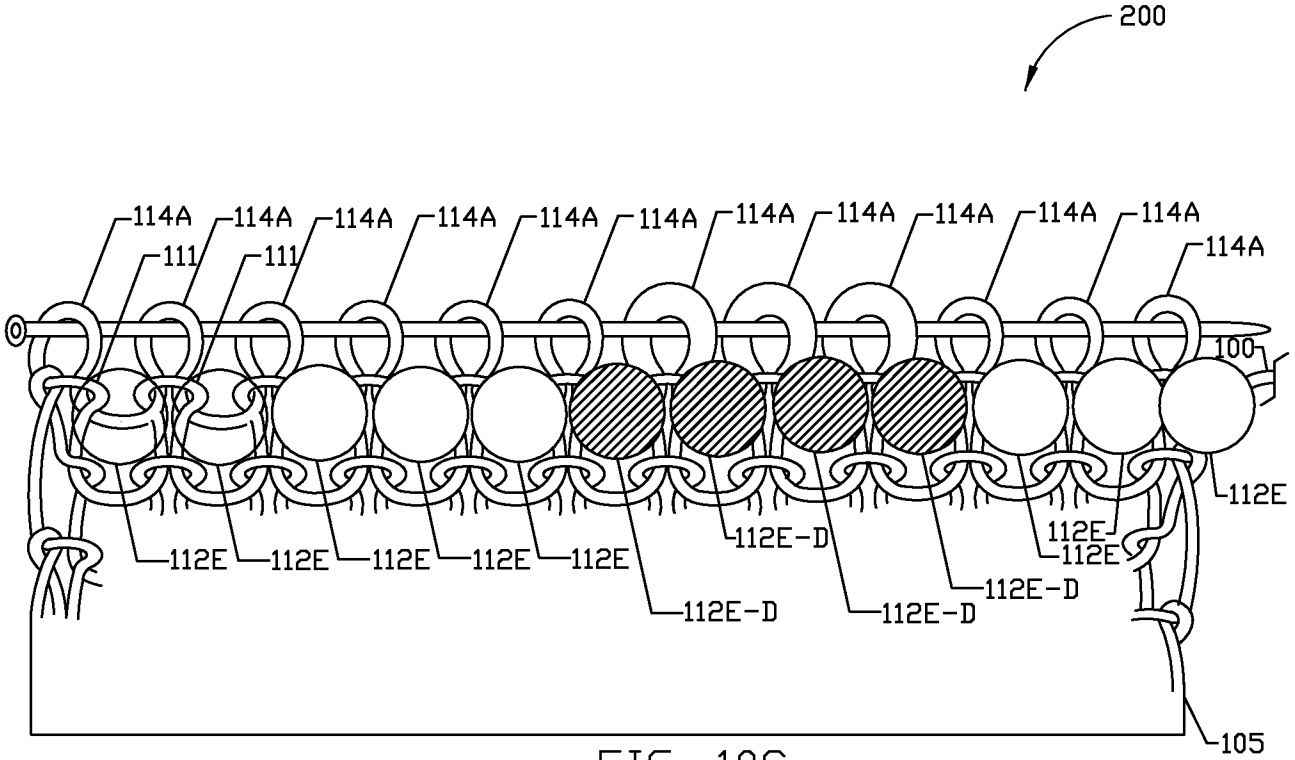

FIGS. 10A-10C illustrate a knitted work in progress 105 formed from a length of material 100 of flexible filament 200 having a plurality of pom-pom stitch indicators and plurality of thick and thin segmented regions 114A. The segmented regions 114A that are held on the knitting needle will become securing factors 111 for the next row of maneuvers. The stitch indicators 112 in this embodiment are light pom-pom stitch indicators 112E and dark pom-pom stitch indicators 112E-D. Each pom-pom stitch indicator marks an end of segmented region 114 that is being looped and pulled through the securing factor 111. The work in progress 105 may be a scarf or other long and narrow textile product that has a plurality of rows of 12 stitches. In this embodiment, the sequence of actions called for knit stitches.

In one embodiment, the pom-pom stitch indicator is a spherical configuration of fibers that are connected at and protrude from a center of the sphere. The fibers may be wool, cotton, plastic, or other material that extends away from the center. The fibers may range between firm and soft. In one embodiment, a pom-pom stitch indicator is any stitch indicator that is larger than the loop through which it is intended to be pulled. Alternatively, the pom-pom stitch indicators may be small spheres or other shapes that are small enough to slide through the loop through which they are intended to be pulled. In addition, the pom-pom stitch indicators may be a solid disc with fibers extending from one or both sides of the disc.

FIG. 10A illustrates the segmented region 114A, pulled through the securing factor 111, to the point where a dark pom-pom stitch indicator 112E-D abuts the securing factor 111. The thickness of the length of material 100 that forms the segmented region 114A is thin enough to be pulled through the securing factor 111. In contrast, the circumference or width of the pom-pom stitch indicators 112 are larger than the width of the loop of the securing factor 111. Other types of stitch indicators 112 may be utilized that are wider than the width of the loop of the corresponding securing factor 111. For example, a bead stitch indicator or a fabric strip stitch indicator may be made large so that the large stitch indicator resists movement past the securing factor 111.

In this embodiment, the pom-pom stitch indicator 112E is too large in diameter to be pulled through the securing factor 111. Therefore, the segmented regions 114A can only be pulled through a securing factor 111 so far and therefore form consistent sized stitches that terminate where the pom-pom stitch indicator abuts the securing factor 111. In addition, larger stitch indicators that resist movement of a segmented region that is being manipulated prevent unwanted shifting of previously formed stitches as further actions are taken to complete the work in progress 105. These large stitch indicators can also prevent unwanted stretching of the final textile product by preventing movement of a stitch indicator through the respective securing factor. The large stitch indicators may be incorporated in other methods of manipulation that involve the pulling of loops through securing factors, such as crochet.

FIGS. 10B and 10C show a front side and a back side, respectively, of the work in progress 105. As described above, 12 segmented regions 114A are held on the knitting needle and are formed as loops pulled through respective securing factors 111. Each segmented region 114 has been pulled through the securing factor until the respective pom-pom stitch indicator 112 prevents further pulling. The user has manipulated the length of material 100 so that all of the pom-pom stitch indicators 112 are on the first side of the work in progress 105. Thereby, the second side of the work in progress is formed from only segmented regions.

The instructions may call for a knit stitch row and a purl stitch row. When the knit row is completed, the work in progress is turned around to begin the next purl row. The user would then perform the sequence of actions alternating the rows between knit and purl. The sequence of actions for forming a knit or a purl stitch are well known in the art and will not be described in detail.

Alternating rows of knit and purl stitches can result in the first side of the work in progress 105 having pom-pom indicators and the second side having segmented regions 114. The visual design on the textile product may be the pom-pom indicators on the first side of the textile product. Alternatively, the visual design may include the pom-pom indicators on the first side of the textile product where the pom-pom indicators have colors that cooperate to form an image, such as a flower or a star. The segmented regions may also form a design on the second side that is similar to the design on the first side or the segmented regions may form a design that is different. The stitch indicators 112 can create a design that corresponds with, is distinct from, or that compliments the design of the segmented regions 114. In one embodiment, the large stitch indicators may be large enough to hide the segmented regions when observing the textile product from the front side.

Figure 11:
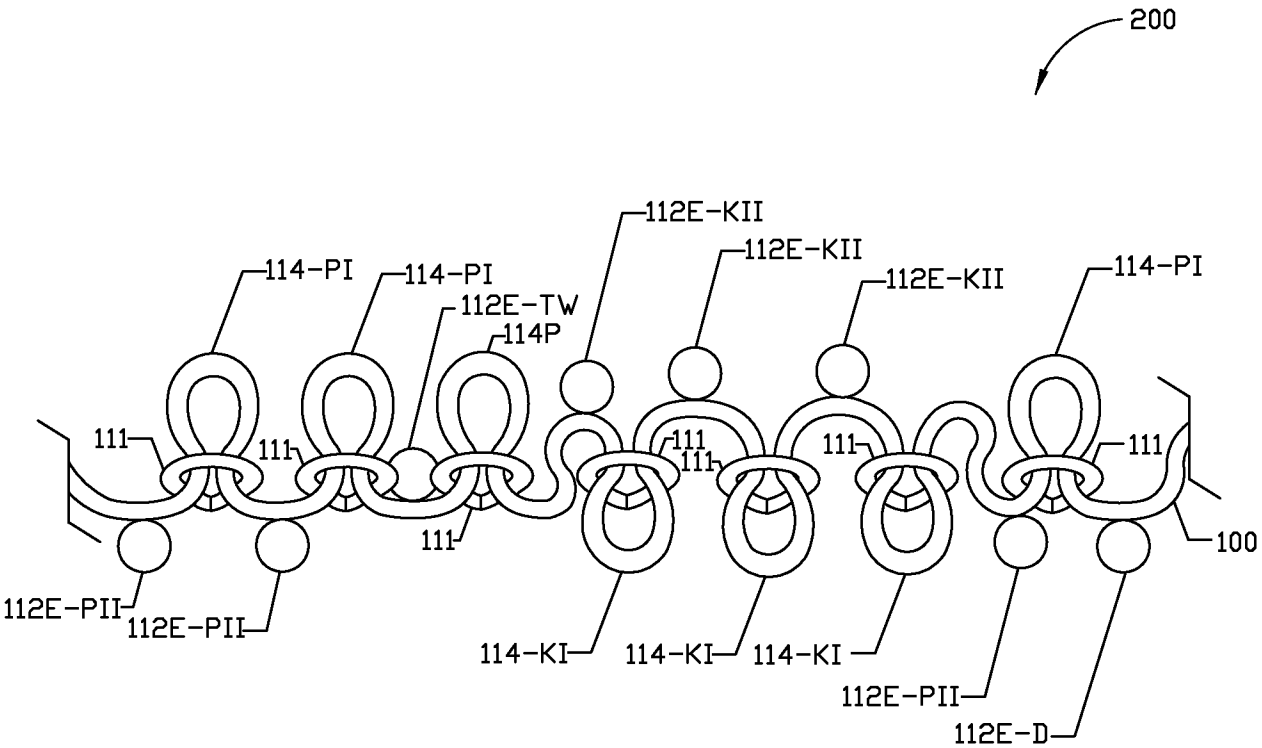
FIG. 11 illustrates an alternative embodiment of a flexible filament having a plurality of stitch indicators manipulated into knit and purl stitches.

FIG. 11 illustrates a top side view of a length of material 100 of flexible filament 200, having knit segmented regions 114-KI, knit stitch indicators 112E-KII, purled segmented regions 114-PI, purl stitch indicators 112E-PII, securing factors 111, and a twisted pom-pom stitch indicator 112E-TW. The securing factors 111 are extending away from a work in progress 105 that has a first side and a second side. In this embodiment, when the user forms a knit stitch with the knit segmented regions 114-KI, the resulting loop is located on the first side of the work in progress 105. In addition, the associated stitch indicator which follows it, 112E-KII is located on the second side of the work in progress 105.

When forming a knit stitch, the user may have the first side of the work in progress facing them so that the knit stitch involves pulling the segmented region towards the user. In contrast, when forming a purl stitch the user may pull the segmented region away from the user. As can be seen in the figure, when the user forms a purl stitch with the segmented region 114-PI the loop of the segmented region is on the second side of the work in progress and the following stitch indicator 112E-PII is on the first side, i.e., the side facing the user. In this embodiment, the purl stitch indicator may be of a first color or design to indicate a purl stitch and the knit stitch indicator may be of a second color or design to indicate a knit stitch. In this way, the flexible filament indicates to the user what sequence of actions to use to form the textile product in the intended manner.

The twisted pom-pom stitch indicator 112E-TW is the stitch indicator at the end of the purl segmented region 114P that abuts the securing factor 111. This purled segmented region 114P was pulled through the securing factor in the same way as purl segmented region 114-PI. However, an additional action was taken with the length of material 100, which was twisted in the location of twisted pom-pom stitch indicator 112E-TW, so that twisted pom-pom stitch indicator 112E-TW is on the second side of the work in progress. In some circumstances an additional action must be taken in order to secure the twisted pom-pom indicator on the second side of the work in progress.

Figure 12:
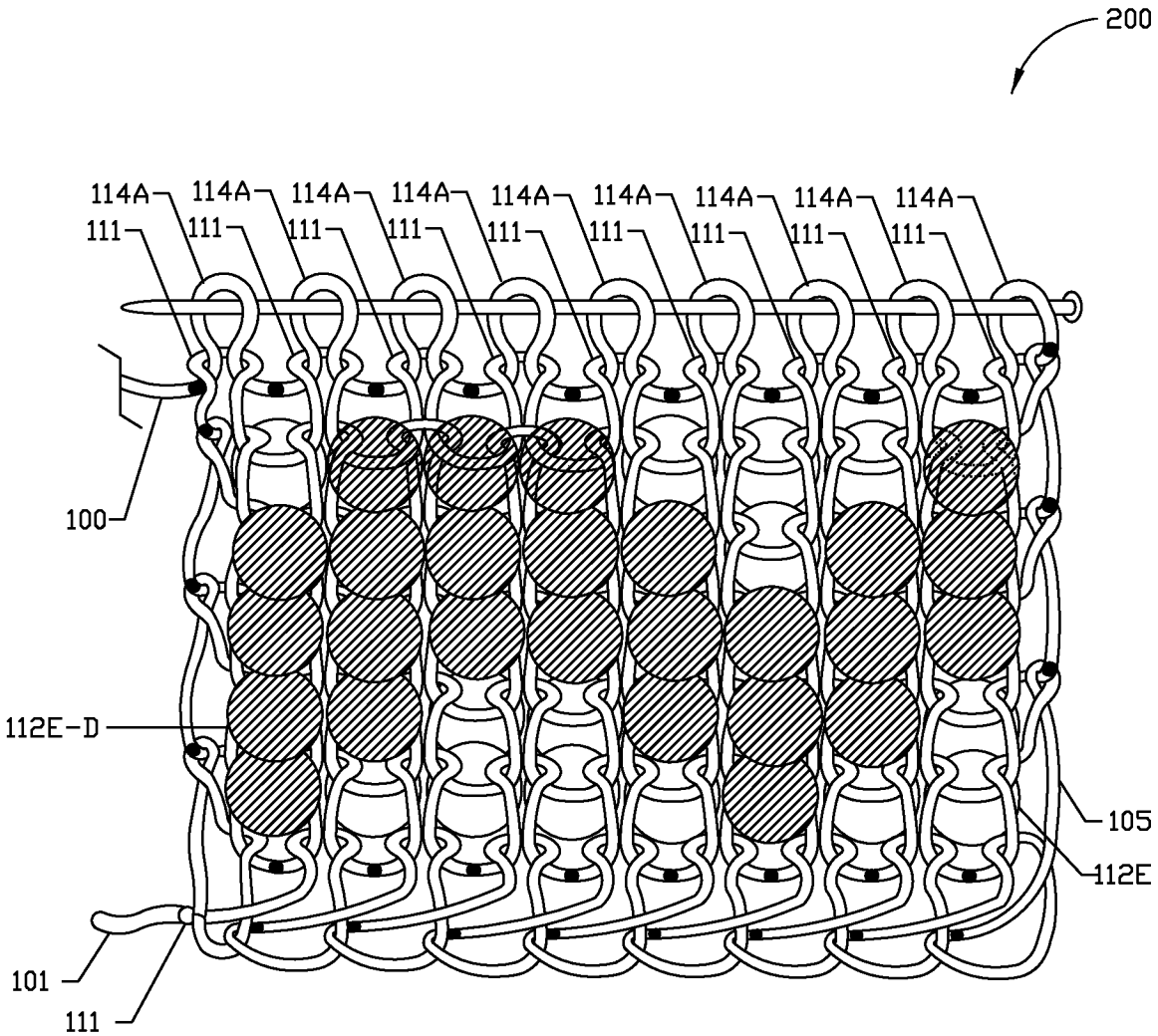
FIG. 12 illustrates a partial textile product formed with knit and purl stitches from a flexible filament having pom-pom stitch indicators.

FIG. 12 illustrates a front view of a work in progress 105 of a knitted product formed from a length of material 100 of flexible filament 200, with light pom-pom stitch indicators 112E and dark pom-pom stitch indicators 112E-D. The work in progress is formed from rows of knit and purl stitches. In this embodiment, the work in progress 105 has light pom-pom stitch indicators 112E on a first side of the work in progress and the dark pom-pom stitch indicators 112E-D are on a second side.

As illustrated in FIG. 11, the placement of the pom-pom stitch indicators 112E is affected by whether the preceding stitch was a knit or purl stitch, as well as additional human manipulation, such as twisting the stitch indicators to be on a desired side.

Figure 13A:
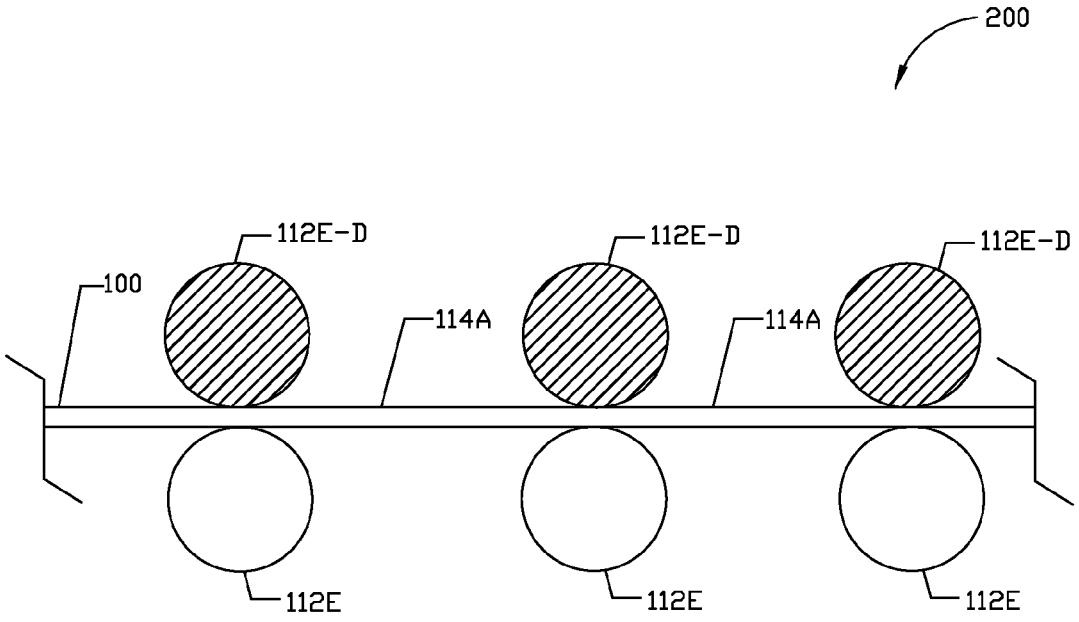
FIGS. 13A and 13B are a side view and a cross-sectional view, respectively, of a flexible filament having double pom-pom stitch indicators.
Figure 13B:
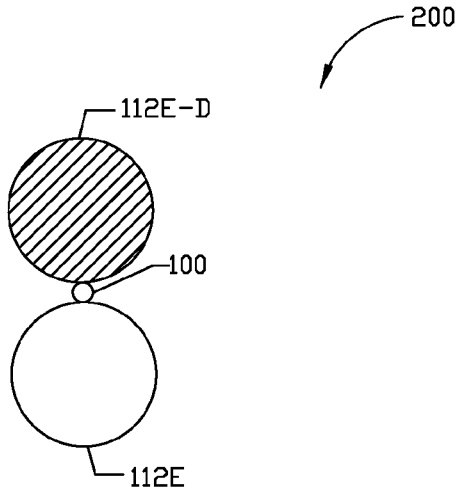

FIGS. 13A and 13B illustrate a top view and a cross-sectional view, respectively, of a length of material 100 of flexible filament 200 with doubled pom-pom stitch indicators 112E. The double pom-pom stitch indicators 112E are two distinct pom-poms, one dark and one light, attached at a single location along the length of material. Additionally, double stitch indicators may be any stitch indicators; not only pom-poms. Also, double stitch indicators may be formed from a single object that extends in two opposing directions or extends radially from the length of material.

The double stitch indicators can be used in the ways described above, such as to mark the end of the subsequent segmented region and to resist movement of the segmented region when the double stitch indicator abuts the securing factor (not shown). The double stitch indicator may also mark the point of emergence of the free end of the length of material.

The double stitch indicators may be manipulated by the user so that one is on each side of the textile product or the double stitch indicator may have both portions on a single side of the textile product. The user will follow the instructions associated with the textile product in order to determine which side of the product each portion of the double stitch indicator should face.

For example, if each double pom-pom stitch indicator 112E included one yellow pom-pom and one blue pom-pom and the first side of the design was a yellow triangle in a blue circle, then the second side would have a blue triangle in a yellow circle. In this case, the pattern on the first side of the textile product will correspond to the pattern on the second side of the textile product. In order to position the correct pom-pom on the correct side, the user will twist the length of material 100 after pulling the segmented region through the securing factor that corresponds to the location where the double stitch indicator should abut.

In this embodiment, the portions of the double stitch indicators may be formed of different materials, such as cotton and wool. The user can feel the difference between a cotton pom-pom and a wool pom-pom without needing a distinction in color. The instructions may recite that all wool pom-pom are to be twisted to be on the first side and all cotton pom-pom are twisted to be on the second side. Other tangible indications may be used, such as differences in density or firmness, inclusion of streamers in one, or any other suitable distinction between the two portions of the double stitch indicators.

Figure 14A:
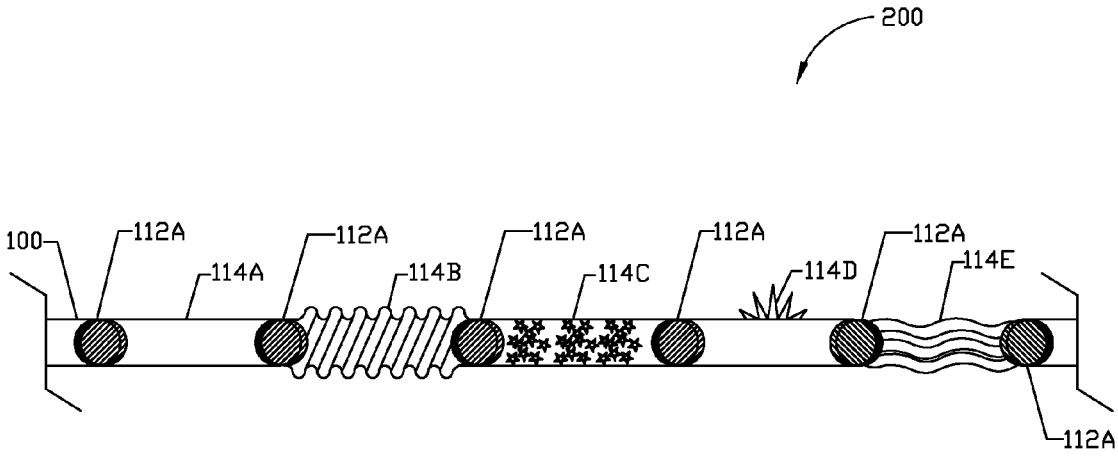
FIGS. 14A and 14B are a side view and a cross-sectional view, respectively, of an alternative embodiment of a plurality of segmented regions on a flexible filament arranged between a plurality of stitch indicators.
Figure 14B:
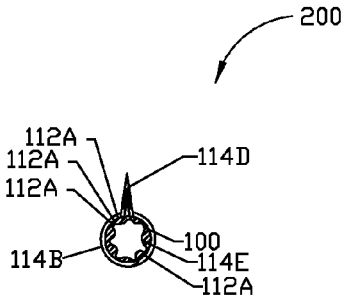

FIGS. 14A and 14B show a side view and a cross-sectional view of a variety of segmented regions 114A-114E along a length of material 100 of flexible filament 200. The segmented regions may include a variety of decorations, accessories, textures, or patterns. For example, the segmented regions may be a plain segmented region 114A, a ribbed segmented region 114B, a glittered segmented region 114C, a fringed segmented region 114D, and a silk segmented region 114E. In this embodiment, the stitch indicators are visual stitch indicators or otherwise flat stitch indicators. In addition, portions of the segmented regions may extend away from the length of material 100 that are not stitch indicators.

An instruction may specify that each certain segmented region 114 indicates the beginning of a certain sequence which the user is to form. For example, starting with a silk segmented region 114E, the user must perform the sequence of a knit, knit, purl.

Additionally, the instructions may provide the user guidance regarding the meaning of a certain sequence of segmented regions. For example, a consecutive sequence of a ribbed segmented region 114B, a glittered segmented region 114C, and a plain segmented region 114A might indicate that a double crochet should be performed. In this situation, the double crochet would begin with the use of the ribbed segmented region 114B, and end with the use of the plain segmented region 114A.

Additionally, one segmented region may indicate which type of sequence of actions is to precede it, involve it, and proceed it. For example, a silk segmented region 114E might indicate that a purl stitch is to be made with the segmented region preceding it, segmented region 114E is to comprise a knit stitch, and a knit stitch is to be made with the proceeding segmented region.

Figure 15A:
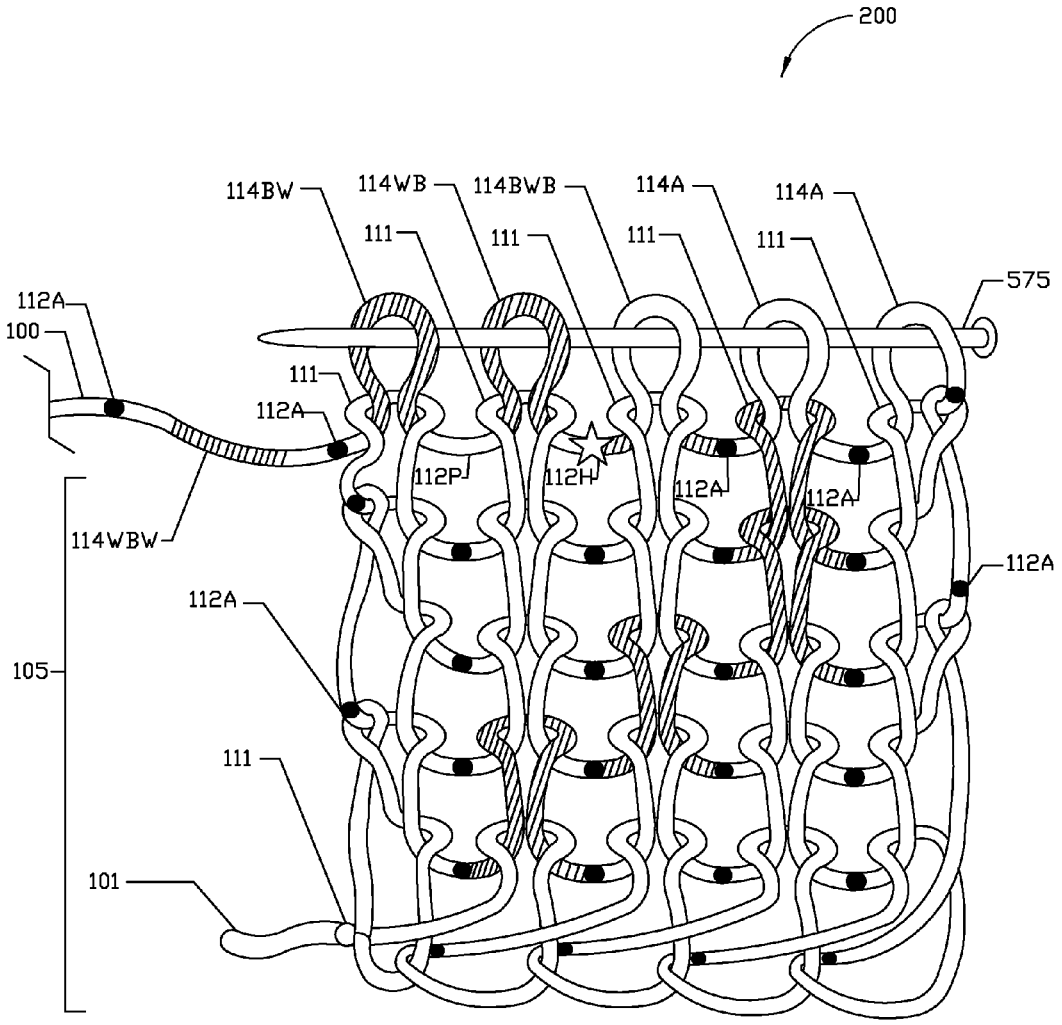
FIGS. 15A and 15B are a front and a back side, respectively, of a partial textile product formed from a flexible filament having a plurality of segmented regions and a plurality of stitch indicators.
Figure 15B:
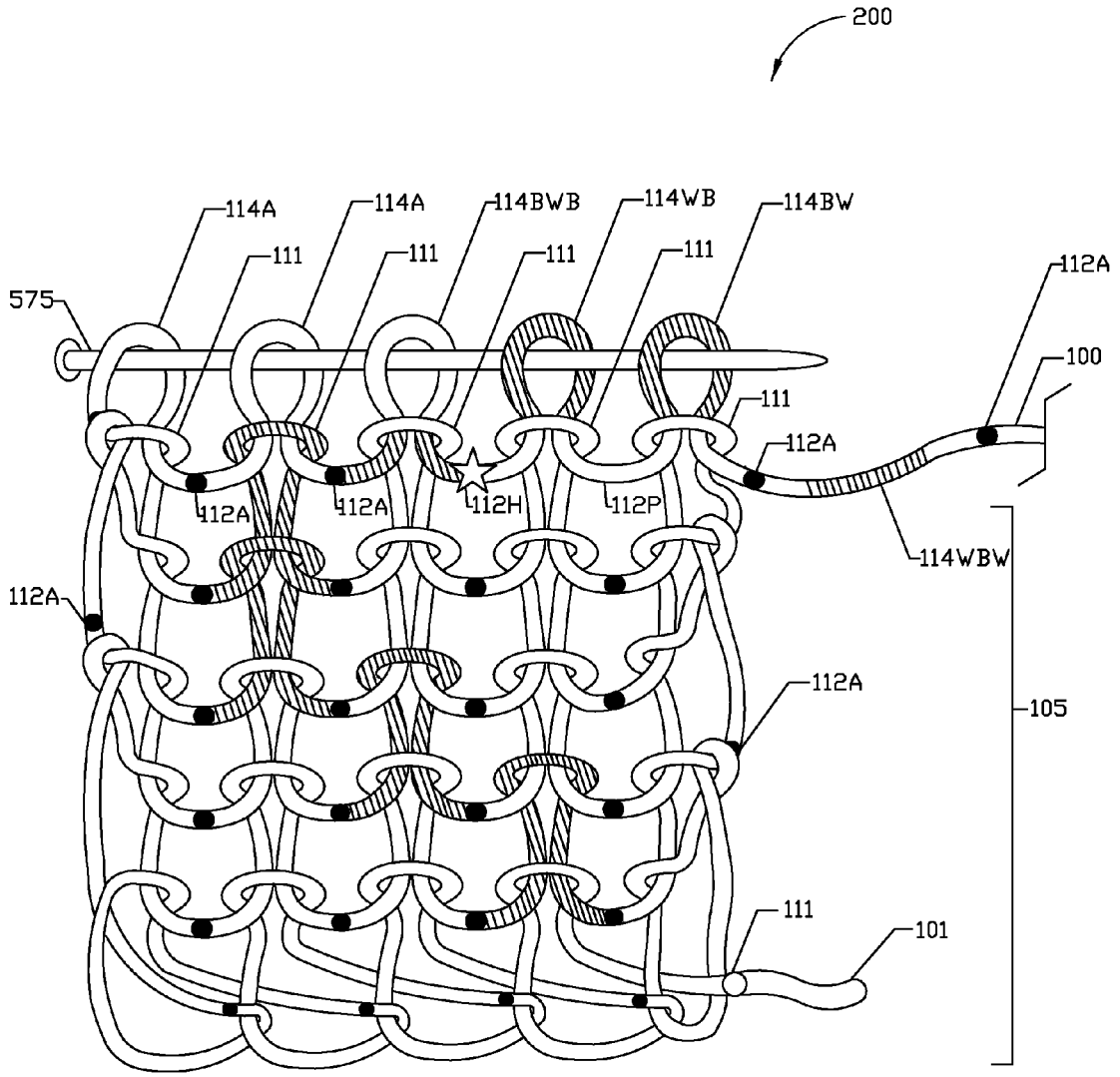

FIGS. 15A and 15B show a front side and a back side view, respectively, of a work in progress 105 of a knitted textile product formed with the length of material 100 of flexible filament 200. The active stitches are held on the knitting needle 575. FIG. 15A illustrates a plurality of knit stitches that are visible on the front side of the textile product. FIG. 15B illustrate a plurality of purl stitches that are visible on the back side of the textile product. The work in progress is a plurality of alternating knit and purl rows. The formation of knit and purl stitches is well known in the art and will not be described in detail herein.

The length of material 100 includes three types of segmented regions 114 that are either white or black, or a combination of the two, where black is shown in this figure as hatched. The segmented regions cooperate to produce the intended visual design. Depending on what side is viewed, different parts of each segmented region 114 are seen. In this embodiment, FIG. 15A, the front of work in progress 105 illustrates segmented regions 114 which are formed as loops where a top of each formed loop is not visible because another segmented region has been pulled through the loop. From FIG. 15B, the back of the work in progress 105, the top portions of the loop of the segmented regions 114 are visible. In this embodiment, the stitches are illustrated as loose or otherwise spaced such that the stitch indicators that are on the back side of the work in progress 105 can be seen from the front side. However, the stitches may be formed more tightly so that the stitch indicators would not be visible from the front side.

In this embodiment, the design on the back is a slightly altered mirror image of the design on the front. The alteration of the mirror image results from the way the segmented regions interact as the length of material is manipulated. Alternatively, the design on the front side may be distinct or otherwise independent of the design on the back side.

The design includes dot stitch indicators 112A, star stitch indicators 112H, and long stitch indicators 112P. The long stitch indicator 112P is a stitch indicator that occupies a portion of the length of material 100 between two segmented regions 114. The long stitch indicator 112P is visible from the back side of the work in progress and the related segmented regions are on the front side. In addition, the segmented regions may alternate between a light color and a variation of darker colors illustrated by the plain segmented regions and the hatched segmented regions, respectively. From right to left, segmented region 114BWB is bordered by dot stitch indicator 112A and star stitch indicator 112H. The segmented region 114BWB is black on its outer edges, and white in its central area. This kind of design can be helpful to produce desired designs on at least one side of the textile product.

Next, 114WB is bordered by star stitch indicator 112H and long stitch indicator 112P. From right to left, segmented region 114WB starts out white, then becomes black for the remainder. Again, this design can be used to produce the desired pattern of the textile product. Long stitch indicator 112P comprises a long area of white. This entire long area is to be considered the stitch indicator. Again, this design can be useful in achieving the desired pattern of the textile product.

Next, segmented region 114BW is bordered by long stitch indicator 112P and dot stitch indicator 112A. From right to left, segmented region 114BW starts out black, then becomes white for the remainder of its length. Next, segmented region 114WBW is white on its outer edges, and black in the central area.

Figure 16:
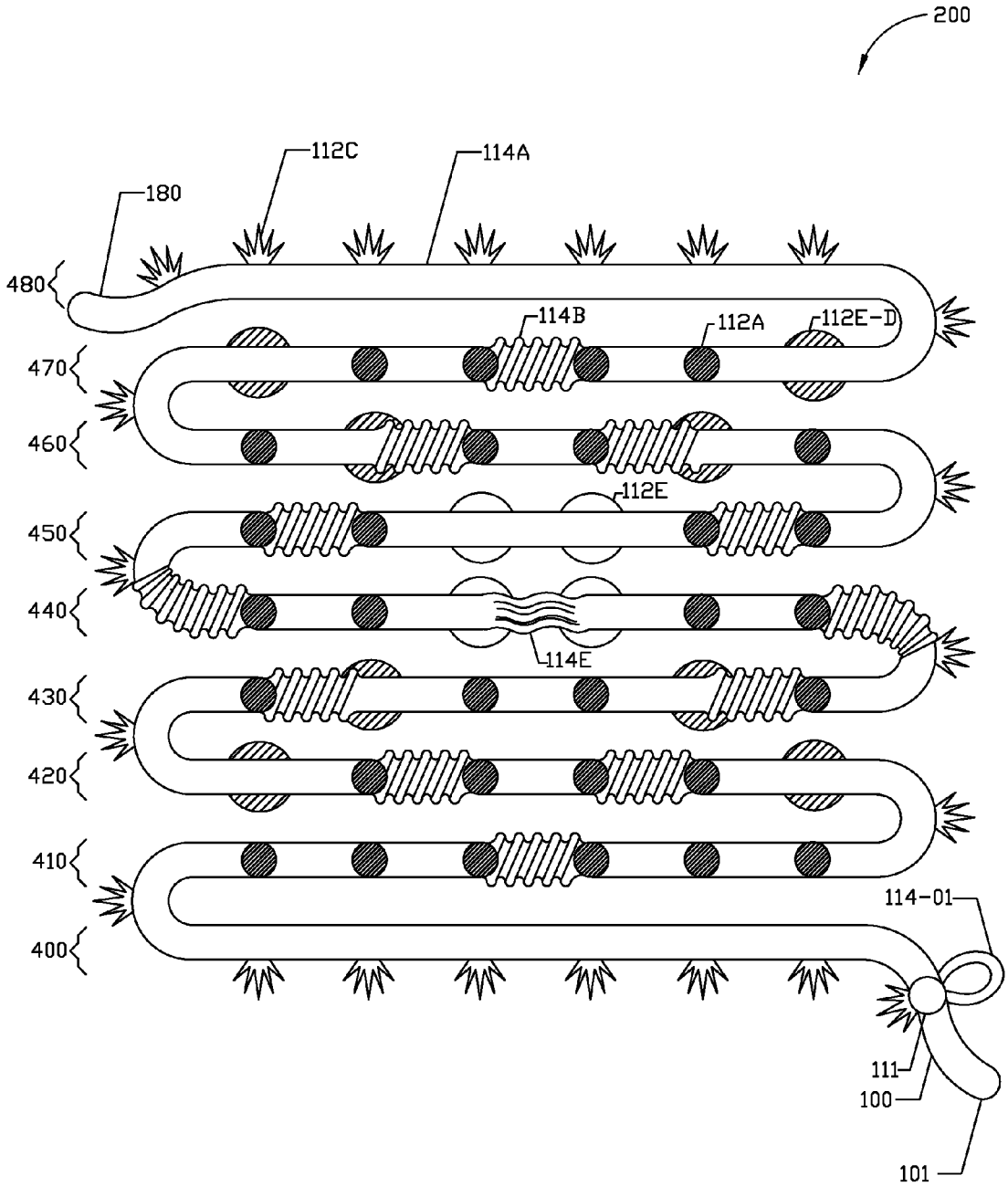
FIG. 16 illustrates a flexible filament from a first end to a second end, having a plurality of segmented regions and a plurality of stitch indicators that are configured to form a visual pattern on a textile product.

FIG. 16 illustrates a length of material 100 of flexible filament 200 from a beginning 101 to an end 180. This length of material 100 includes a fringe stitch indicator 112C, a dot stitch indicator 112A, pom-pom stitch indicator 112E, dark pom-pom stitch indicators 112E-D, a plain segmented region 114A, a ribbed segmented region 114B, and a silk segmented region 114E. An initial segmented region 114-01 is formed into an initial loop adjacent a securing factor or knot 111.

In one embodiment, the sequence of actions for this length of material 100 is knitting. A plurality of stitches will form a first row 400 from right to left starting with the initial loop 114-01. The first row includes 8 fringe stitch indicators 112C. A subsequent row 410 will then be knitted from left to right, and so on, until the textile product is complete. Each row 400-480 will include seven manipulations or sequences of actions with segmented regions 114. In this embodiment, the stitch indicators 112 only indicate where each sequence of actions should end and do not indicate the type of sequence to be performed. Each segmented region 114A is intended to form a knit stitch for the rows 420, 440, 460, and 480. In addition each segmented region 114A is intended to form a purl stitch for the rows 410, 430, 450, and 470. Once formed, the knit stitches will be visible from one side of the textile product and the purl stitches will be visible from the other. The first row of stitches, row 400, may be cast-on stitches and not necessarily knit stitches.

The length of material 100 includes the ribbed segmented regions 114B and the silk segmented region 114E that may form a different stitch than the plain segmented regions 114, even if they are on the same row. For example, every ribbed segmented region 114B and silk segmented region 114E may be a purl stitch for rows 420, 440, 460, and 480 and a knit stitch for rows 410, 430, 450, and 470.

This embodiment also includes light pom-pom stitch indicators 112E and dark pom-pom stitch indicators 112E-D that may make a pattern of their own, such as an "X" pattern, as shown. A center of the "X" may have light pom-pom stitch indicators 112E and the legs of the "X" pattern may be dark pom-pom stitch indicators 112E-D.

Figure 17:
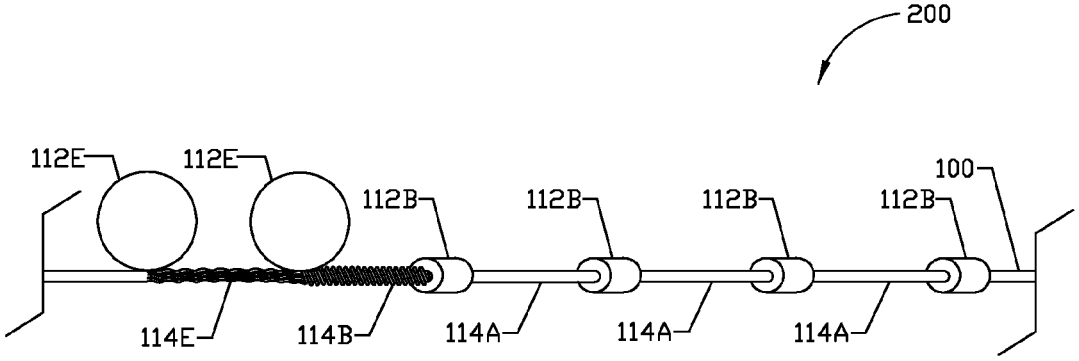
FIG. 17 illustrates another alternative embodiment of a flexible filament having a plurality of segmented regions and a plurality of stitch indicators.

FIG. 17 illustrates an alternative embodiment of a length of material 100 of flexible filament 200, having bead stitch indicators 112B and pom-pom stitch indicators 112E that are two different shapes and sizes. In this embodiment, the four consecutive cylindrical or bead stitch indicators 112B work together to indicate a sequence of actions to take that includes each of the cylindrical stitch indicators and the related segmented regions. The instructions may provide the user guidance regarding the meaning of the different number of consecutive same or similar stitch indicators. For example, the instructions may indicate that all of a single type of stitch indicator will be used for a particular sequence of actions, which may be a plurality of stitches, or a single stitch. Therefore, the first stitch indicator in the group of stitch indicators of the same type will mark the starting point and the last stitch indicator in the group will mark the ending point. More particularly, the single stitch will begin with the first stitch indicator and end with the last stitch indicator in the consecutive similar stitch indicators.

For example, the instructions may indicate that the four consecutive bead stitch indicators 112B and the corresponding segmented regions 114A form a first type of stitch, i.e., the first group. In addition, the pom-pom stitch indicators 112E and the silk segmented region 114E will form a second type of stitch, i.e., the second group. The ribbed segmented region 114B may be considered a connection region between the first group and the second group. In one embodiment, the ribbed segmented region 114B will form a single slip stitch, i.e., a single loop that couples the first group to the second group of stitch indicators. The slip stitch is a well-known crochet stitch, the formation of which will not be described in detail. If the first group and the second group are not visually distinct, the connection region, segmented region 114B, may be a different color or other characteristic that sufficiently distinguishes the connection region from the segmented regions associated with one or both of the groups.

Following the instructions, the user will perform the first type of stitch with the first group starting from the point of emergence adjacent the last securing factor and using all of the stitch indicators of the first group. The first type of stitch will end with the last stitch indicator of the first group that abuts the ribbed segmented region 114B. The first type of stitch will be formed in conjunction with the subsequent securing factor. The user will next form the slip stitch with the segmented region 114B of the length of material 100, pulling the segmented region 114B until the pom-pom stitch indicator 112E abuts the respective securing factor.

In this embodiment, the four consecutive bead stitch indicators 112B may be used to indicate the placement for a double crochet, i.e., a three-loop stitch. The two pom-pom stitch indicators 112E that border the silk segmented region 114E may also form a slip stitch or some other single-loop stitch.

Note that in addition to indicating a type of stitch, consecutive stitch indicators of a same or similar type may also indicate a portion of a type of stitch, or a sequence of a plurality of stitches. Alternatively, the instructions may provide the user guidance regarding the meaning of a certain sequence of stitch indicators. For example, a consecutive sequence of two bead stitch indicators, a dot stitch indicator, and a sparkle stitch indicator might indicate that a double crochet should be performed. In this situation, the double crochet would begin with the first of the two bead stitch indicators, and end with the sparkle stitch indicator.

Figure 18:
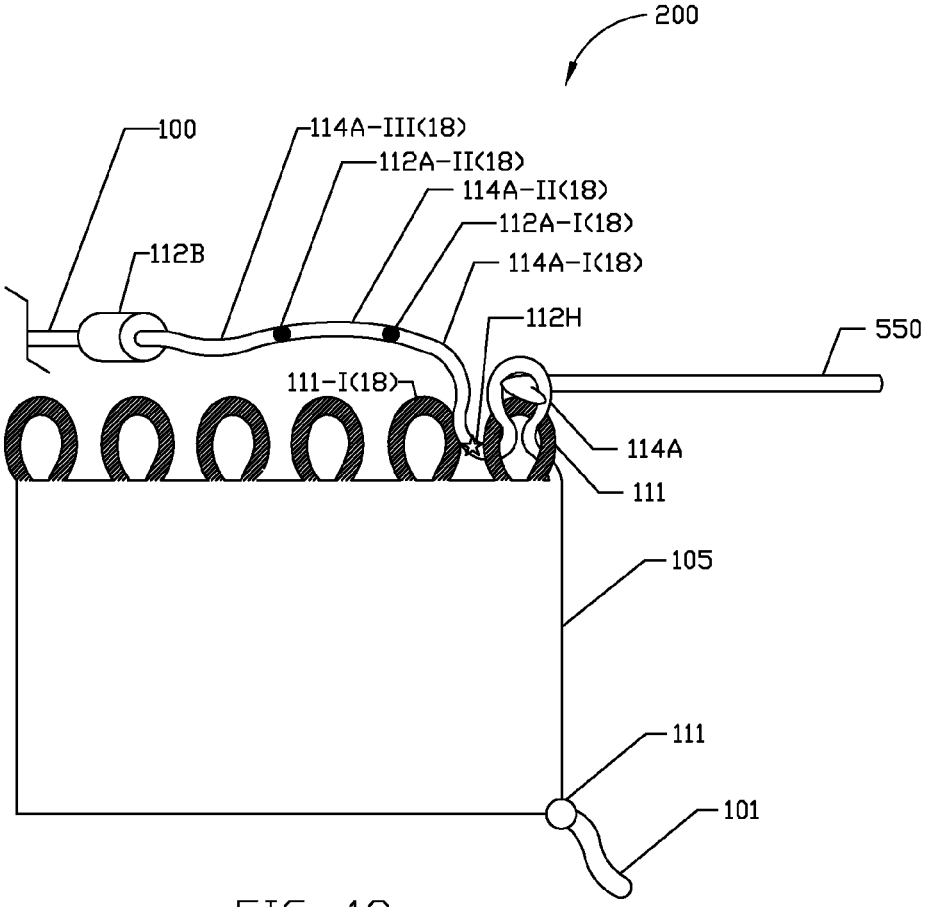
FIG. 18 illustrates a flexible filament having a plurality of stitch indicators and segmented regions during a crochet process.

FIG. 18 illustrates a work in progress 105 of a length of material 100 of flexible filament 200, being crocheted with a crochet hook 550. The length of material 100 includes a star stitch indicator 112H, followed by two dot stitch indicators 112A, and a bead stitch indicator 112B. The star stitch indicator 112H marks the beginning of the next stitch or sequence of actions and may instruct the user to form a three-loop stitch using the three segmented regions 114A-I(18), 114A-II(18), and 114A-III(18) between the star and the bead stitch indicators. Such a three-loop stitch may be a double crochet stitch. In this embodiment, the star stitch indicators and the bead stitch indicators provide the instructions, and the dot stitch indicators provide guidance as to where to form the three loops required for the double crochet stitch.

Accordingly, a first loop is formed from the segmented region 114A-I(18), which begins after the star stitch indicator 112H and ends at the point where dot stitch indicator 112A-I(18) meets the respective securing factor 111-I(18). A second loop is formed from the segmented region 114A-II(18), which ends at the point where the dot stitch indicator 112A-II(18) meets the respective securing factor, which in this case would be the loop previously formed with segmented region 114A-I(18). A third loop is formed from the segmented region 114A-III(18), which ends at the point where bead stitch indicator 112B meets the respective securing factor, which in this case would be the loop previously formed with segmented region 114A-II(18).

A manufacturer determines a length of each segmented region based on a number of factors, such as a type of material used for that segmented region, a thickness of the material for that segmented region, a size of needle used for that segmented region 114, a tension intended to be applied to that segmented region during formation, and a type of stitch or sequence of actions to be performed, to name a few. The manufacturer may also evaluate the size of the stitch indicators 112 on the length of material 100 and alter the length of the segmented regions accordingly.

Figure 19:
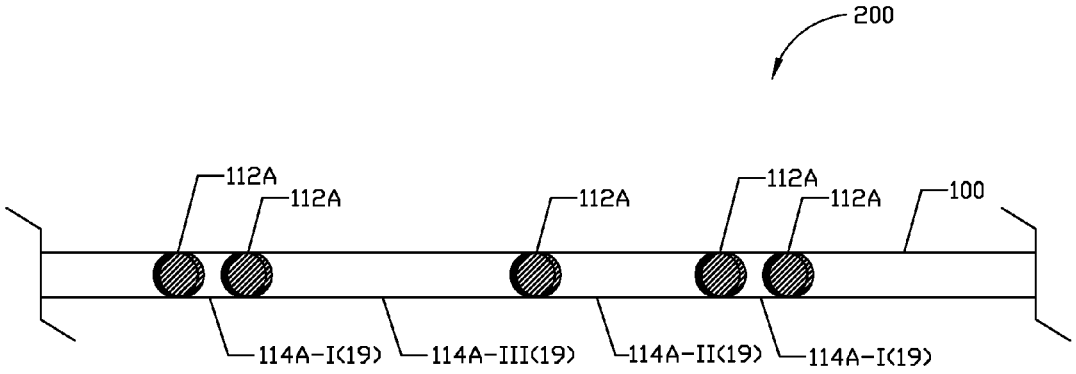
FIG. 19 illustrates a flexible filament having a plurality of stitch indicators and segmented regions arranged according to an alternative embodiment of the present disclosure.

FIG. 19 illustrates another embodiment of the flexible filament having the length of material 100 of flexible filament 200, with dot stitch indicators 112A and segmented regions 114A-I(19), 114A-II(19), and 114A-III(19). In this embodiment, the segmented regions have different lengths that correspond to different sequences of actions intended for each segmented region. For example, the smallest segmented regions 114A-I(19) may correspond to a single slip stitch, which uses a single loop. The longest segmented region 114A-III(19) may correspond to a double crochet stitch, which uses three loops. This is one embodiment where the stitch indicators mark the end of one segmented region and beginning of the next segmented region and the length of the segmented region informs the user of the type of stitch to perform.

FIGS. 20A-20F illustrate the sequence of actions to form a double crochet stitch with a flexible filament 200, having a length of material 100 with stitch indicators and segmented regions formed thereon. A crochet hook 550 is used to form loops and to manipulate the loops to form the double crochet stitch on a work in progress 105. The length of material 100 includes, from right to left, a first star stitch indicator 112H-I, a first segmented region 114A-I(20), a first dot stitch indicator 112A-I(20), a second segmented region 114A-II(20), a second dot stitch indicator 112A-II(20), a third segmented region 114A-III(20), and a second star stitch indicator 112H-II.

The first, second, and third segmented regions 114A-I(20), 114A-II(20), and 114A-III(20) are bordered by the first and second star stitch indicators 112H-I, 112H-II. Each of the first, second, and third segmented regions become a single loop of the double crochet stitch, which is a three-loop stitch. Although the double crochet stitch includes multiple loops formed from multiple segmented regions, the double crochet is considered a single stitch.

An initial loop, formed from the segmented region 114A, is held on the crochet hook 550 prior to forming the first loop of the double crochet stitch. The star stitch indicator 112H-I marks the point of emergence of the free end of the length of material extending from the segmented region 114A that forms the initial loop on the crochet hook. The star stitch indicator 112H-I also marks the beginning of the multi-loop double crochet stitch to be made with the next three stitch indicators and with the first, second, and third segmented regions 114A-I(20), 114A-II(20), and 114A-III(20).

The instructions for this embodiment will inform the user that star stitch indicators 112H are meant to border double crochet stitches, and that dot stitch indicators 112A are meant to designate the segmented regions 114 to form the loops of the double crochet stitch. The first, second, and third segmented regions 114A-I(20), 114A-II(20), and 114A-III(20) between the first and second star stitch indicators 112H each have a length sized and shaped to sufficiently form the respective loop of the double crochet stitch.

Figure 20A:
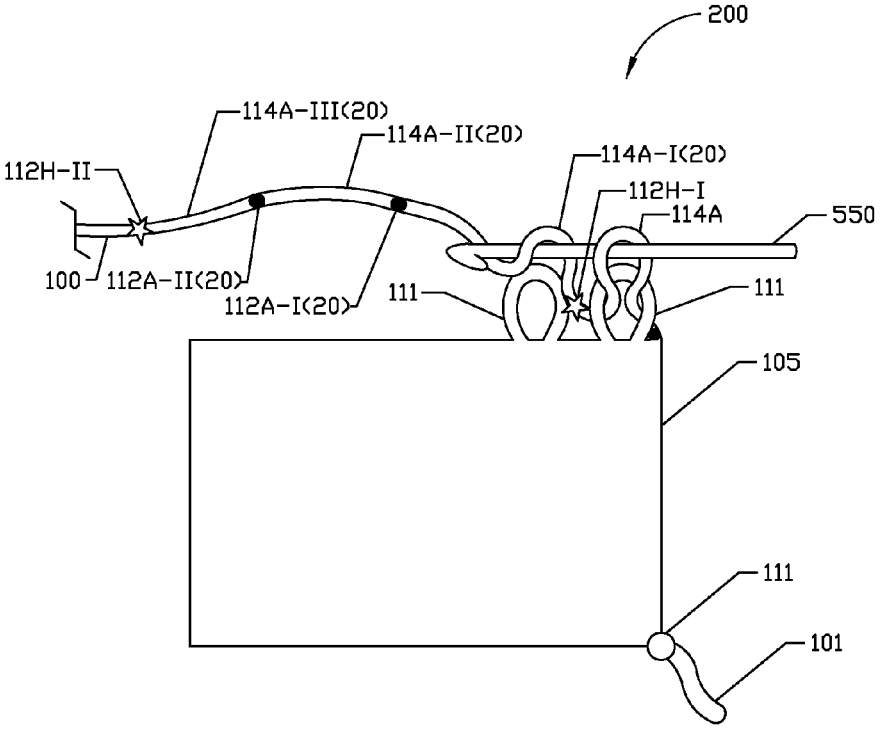
FIGS. 20A-20F illustrate a sequence of crocheting a flexible filament having a plurality of stitch indicators and segmented regions.
Figure 20B:
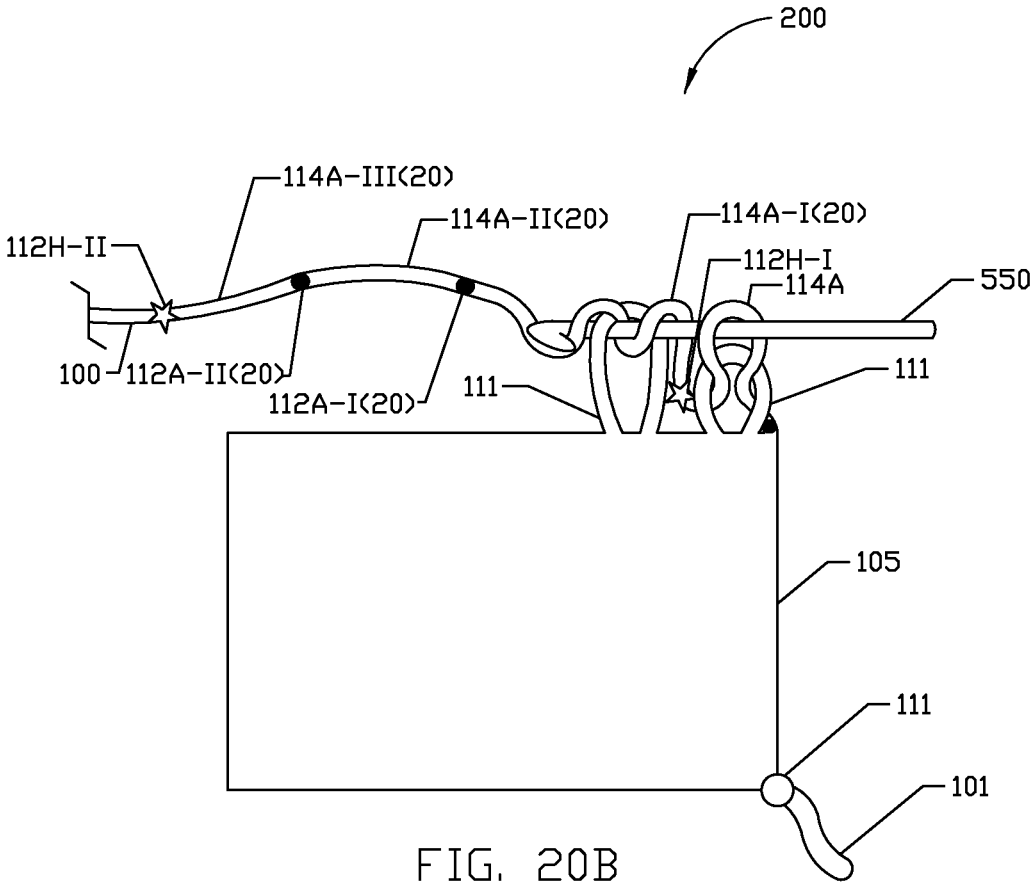
Figure 20C:
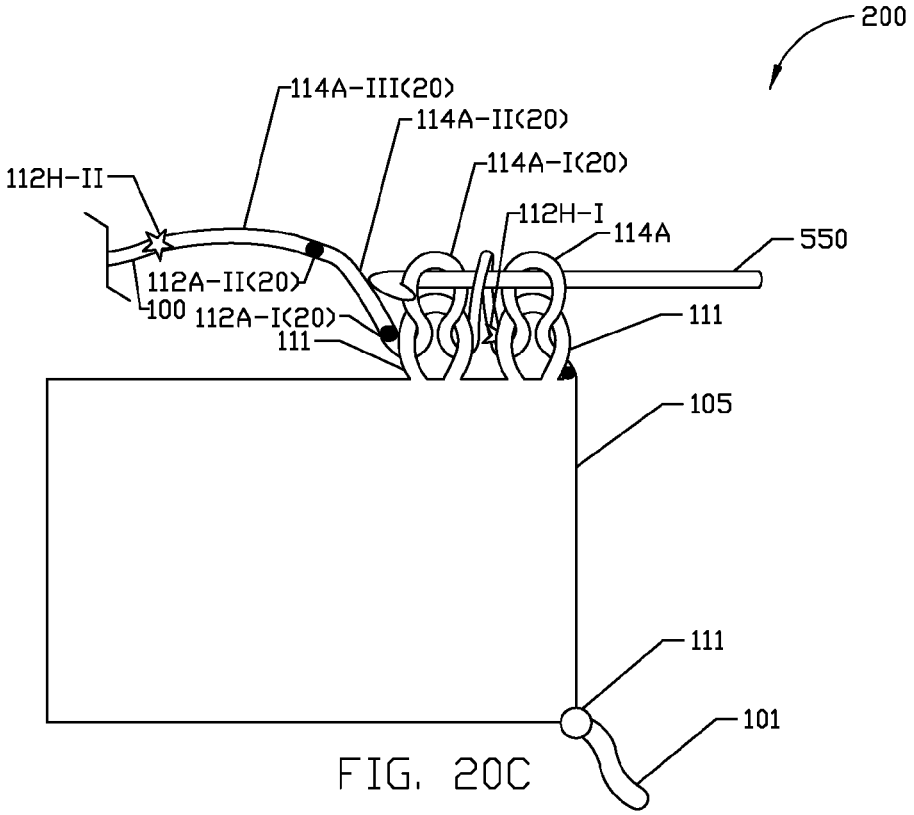

As illustrated in FIG. 20A, the user wraps the first segmented region 114A-I(20) around the crochet hook 550 one time. In FIG. 20B, the crochet hook is partially inserted into a next securing factor 111 from a first side so that the crochet hook may grasp a remaining portion of the first segmented region 114A-I(20) from a second side of the securing factor. In FIG. 20C, the user pulls the remaining portion of the first segmented region 114A-I(20) through the securing factor 111 to the first side until the first dot stitch indicator 112A-I(20) abuts the securing factor.

Figure 20D:
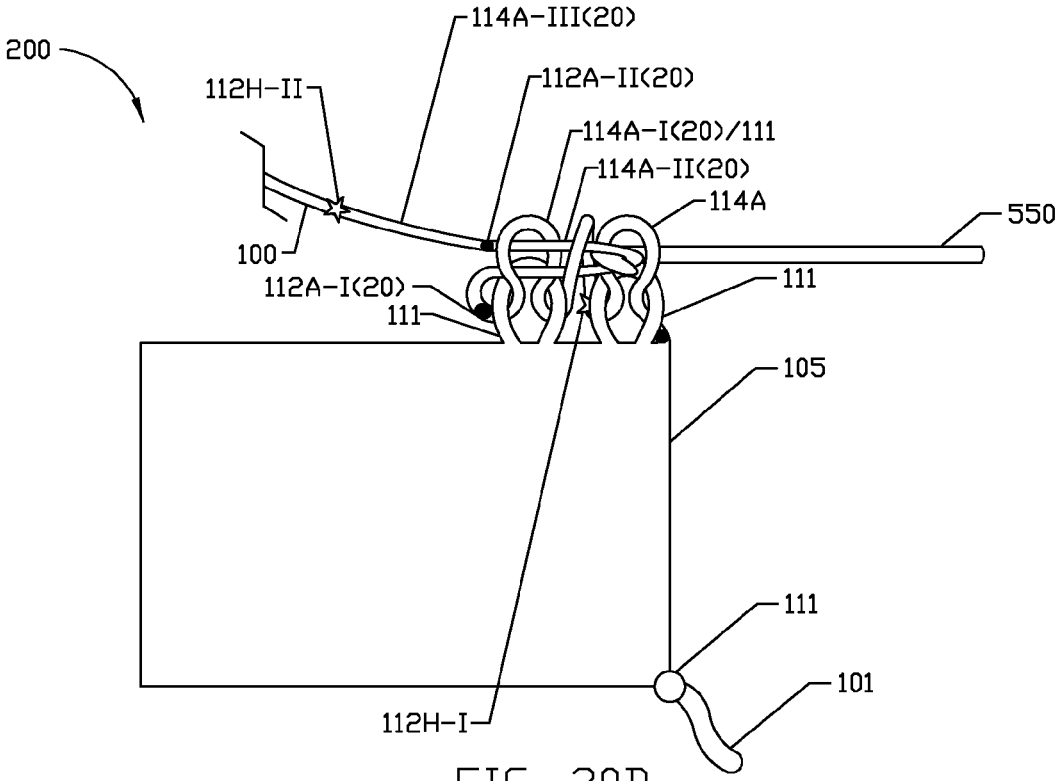

In FIG. 20D, the second loop is formed from the second segmented region 114A-II(20) that starts and ends with the first and second dot stitch indicators 112A-I(20) and 112A-II(20), respectively. The user grasps the second segmented region 114A-II(20) from the second side of the securing factor 111 and pulls the second segmented region through the loop of the first segmented region 114A-I(20), the portion of the first segmented region wrapped around the crochet hook, and the initial loop 114A. Thereby, 114A-I(20) becomes the securing factor for 114A-II(20), and is called 114A-I(20)/111 in this Figure.

Figure 20E:
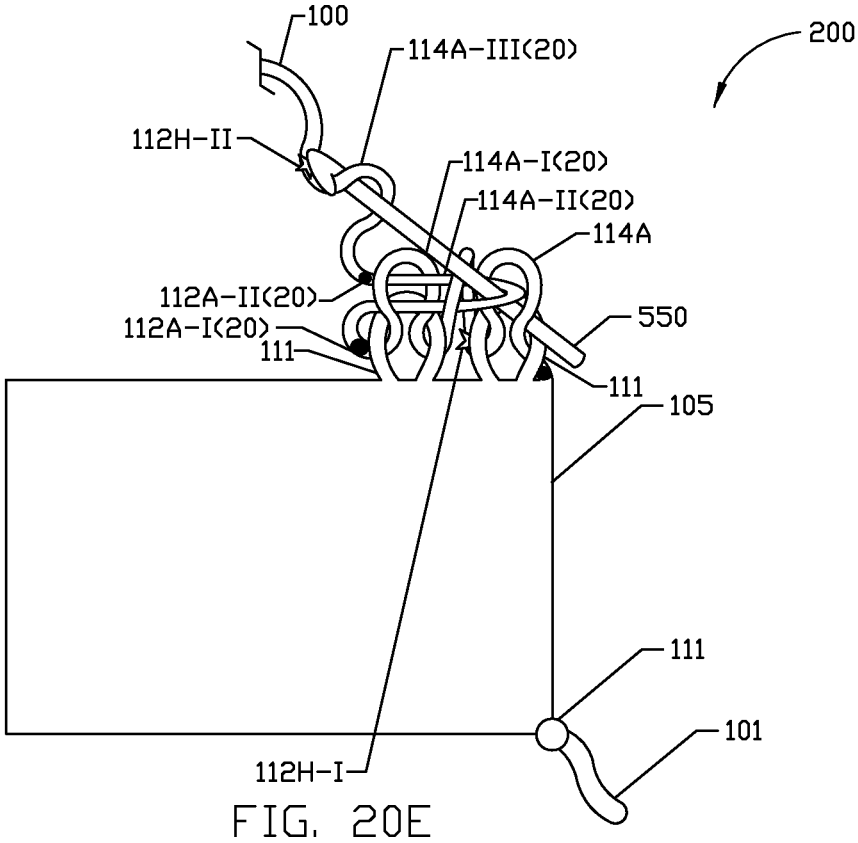

In FIG. 20E, the user moves the crochet hook 550 to grasp the third segmented region 114A-III(20) that is on the second side of the securing factor, which in this case is segmented region 114A-II(20). Therefore, in this Figure, it is called 114A-II(20)/111. Prior to grasping the third segmented region 114A-III(20), the crochet hook only holds the loop formed from the second segmented region, 114A-II(20), and the initial loop 114A. The user also wraps the third segmented region around the crochet hook one time.

Figure 20F:
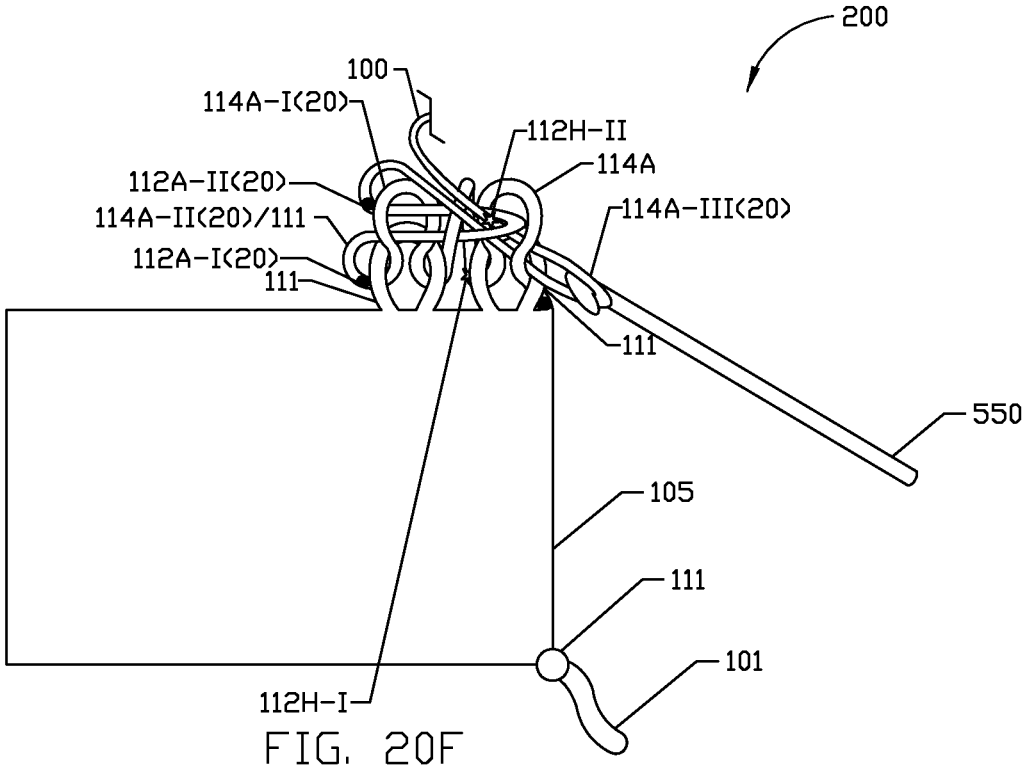

In FIG. 20F, the user pulls the third segmented region 114A-III(20) through the loop formed by the second segmented region 114A-II(20) and through the initial loop 114A to complete the double crochet stitch. Segmented region 114A-II(20) becomes the securing factor of the third loop, so in this Figure it is labeled 114A-II(20)/111. The second star stitch indicator 112H-II marks the end of the third loop and the new point of emergence of the free end of the length of material 100.

FIGS. 21A-21F illustrate another embodiment of the sequence of actions to form a double crochet stitch formed on a work in progress 105 with a length of material 100 of flexible filament 200. In this embodiment the length of material 100 includes a first star stitch indicator 112H-I and a second star stitch indicator 112H-II that are separated by a single long segmented region 114A-I+II+III. The segmented region 114A-I+II+III is manufactured to be long enough to adequately form the three loops required for the double crochet stitch. As mentioned above, the double crochet stitch is considered a single stitch even though multiple loops are formed to make the stitch.

As before, the crochet hook has an initial loop 114A already present on the hook prior to beginning the sequence to form the double crochet stitch. The first star stitch indicator marks the point of emergence abutting a previous securing factor 111 and marks the start of the double crochet stitch. The instructions may inform the user that the first and second star stitch indicators border the length of material used to form the three loops of the double crochet stitch.

Figure 21A:
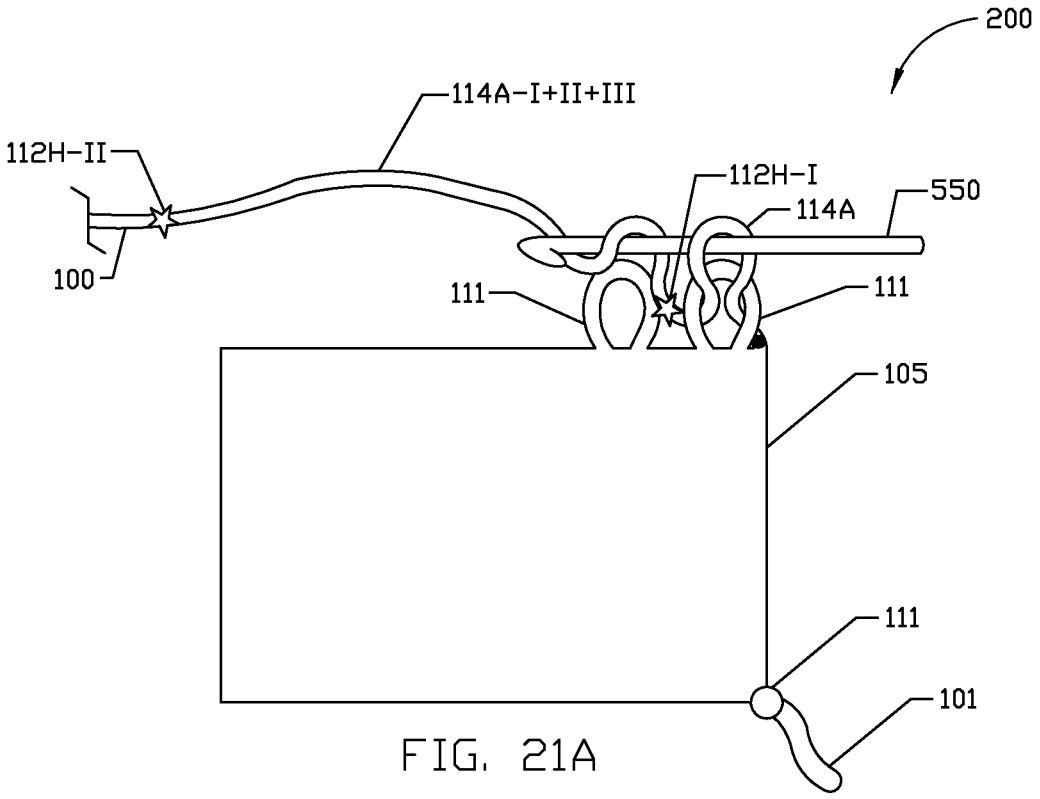
FIGS. 21A-21F illustrate an alternative sequence of crocheting a flexible filament having a plurality of stitch indicators and segmented regions.
Figure 21B:
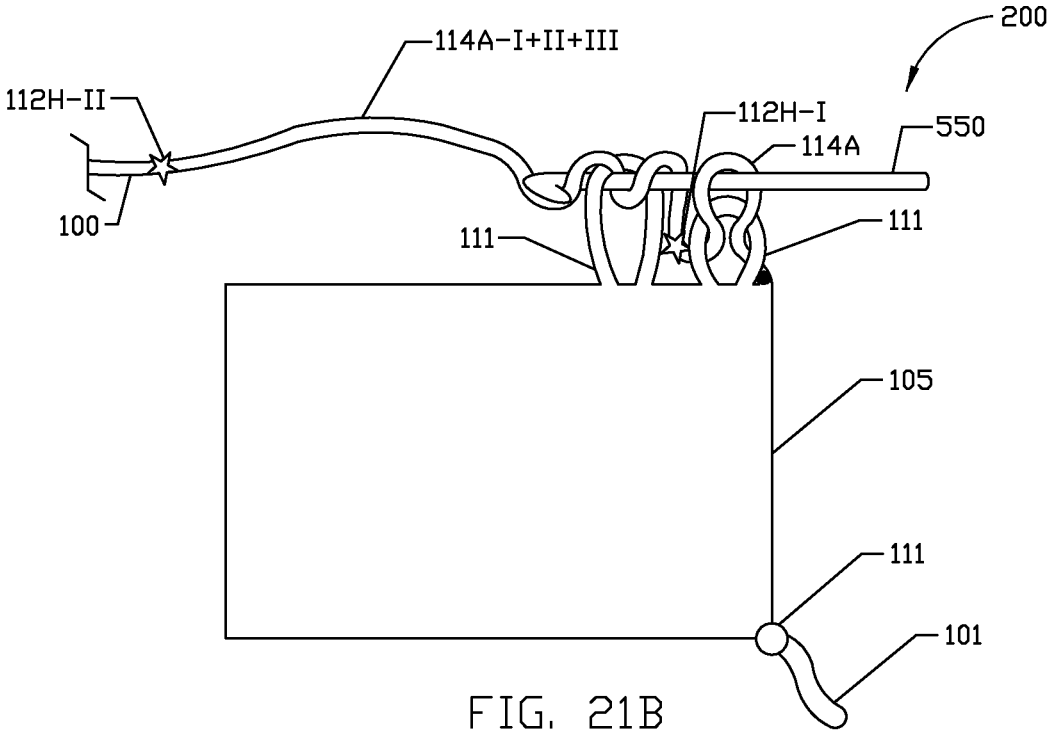

In FIG. 21A, the user wraps the segmented region 114A-I+II+III around the crochet hook 550 one time. In FIG. 21B, the crochet hook is partially inserted into a next securing factor 111 from a first side so that the crochet hook may grasp a portion of the segmented region 114A-I+II+III from a second side of the securing factor. This embodiment is more challenging for the user than the embodiment in FIGS. 20A-20F because the user must control the tension and size of the loops to form the double crochet stitch correctly.

Figure 21C:
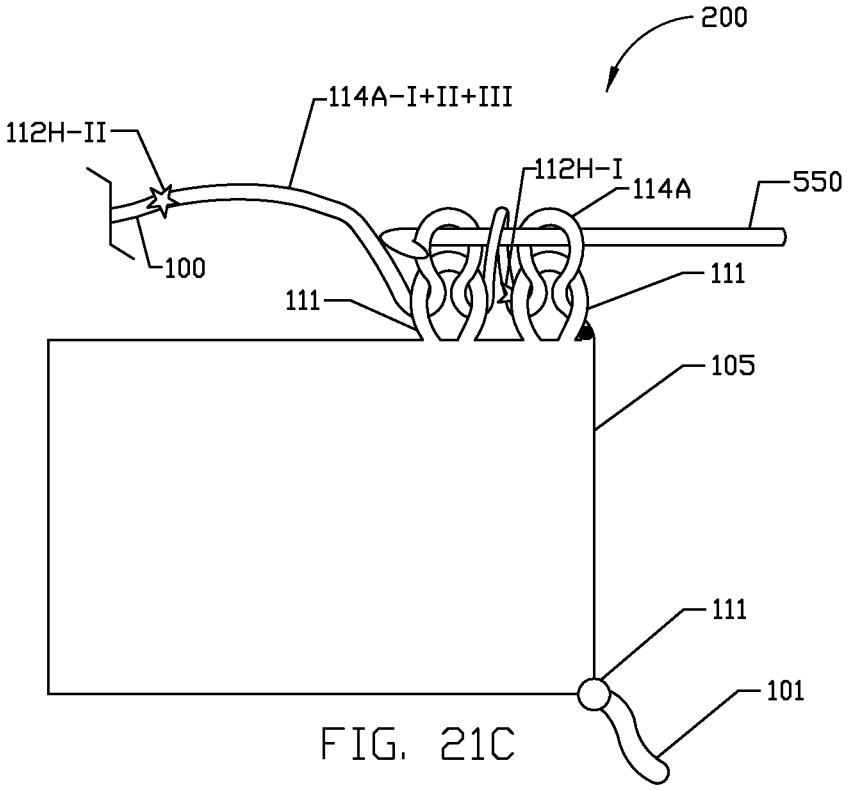
Figure 21D:
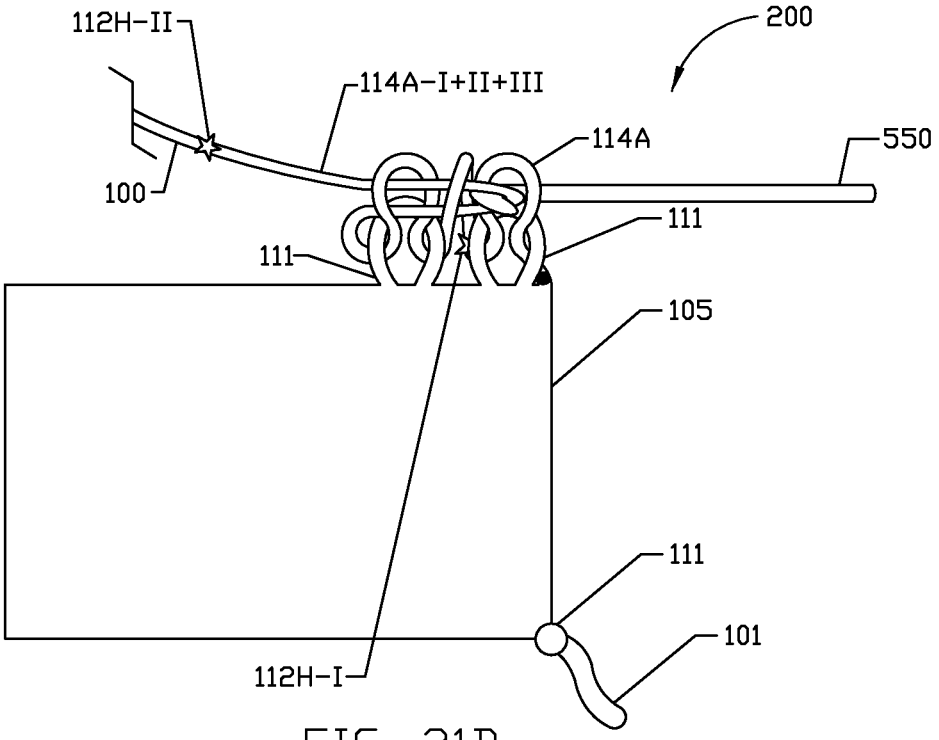

In FIG. 21C, the user pulls the portion of the segmented region 114A-I+II+III through the securing factor to the first side. In FIG. 21D, the second loop is formed from another portion of the segmented region 114A-I+II+III. The user grasps another portion of the segmented region 114A-I+II+III from the second side of the securing factor 111 and pulls the second portion of the segmented region through the first loop, and the portion wrapped around the crochet hook.

Figure 21E:
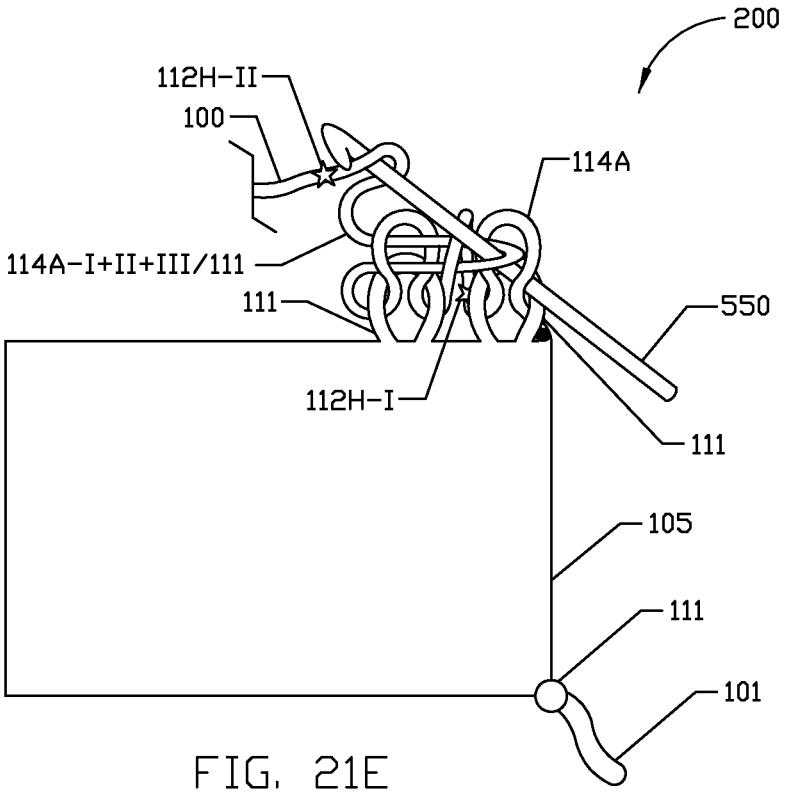

In FIG. 21E, the user moves the crochet hook 550 to grasp the remaining portion of the segmented region 114A-I+II+III that is on the second side of the securing factor 114A-I+II+III/111. Prior to grasping the remaining portion of segmented region 114A-I+II+III, the crochet hook only holds the second loop formed and the initial loop 114A.

Figure 21F:
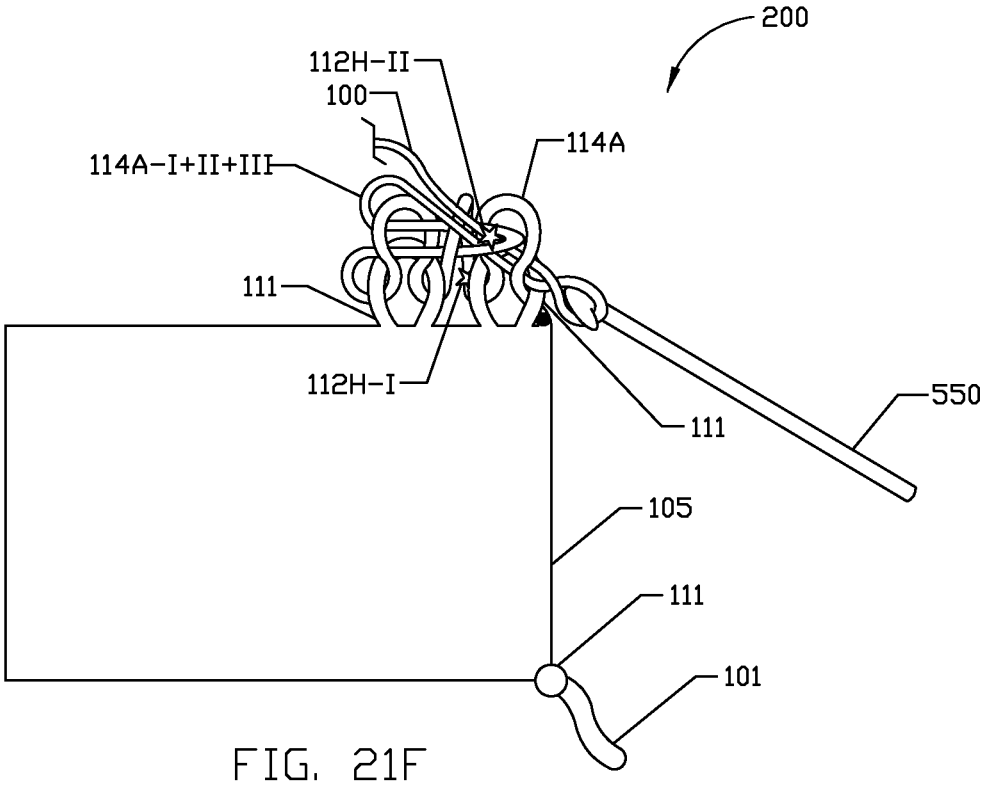

In FIG. 21F, the user pulls the remaining portion of the segmented region 114A-I+II+III through the loop formed by the last portion of segmented region 114A-I+II+III and through the initial loop to complete the double crochet stitch. The second star stitch indicator 112H-II marks the end of the double crochet stitch and the new point of emergence of the free end of the length of material 100.

Figure 22:
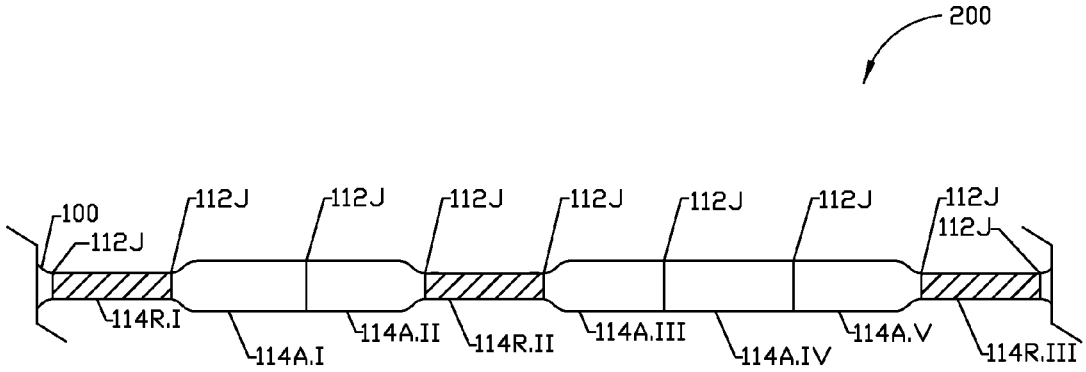
FIGS. 22-24 illustrate alternative embodiments of a flexible filament having a plurality of stitch indicators and segmented regions.

FIG. 22 illustrates a length of material 100 of flexible filament 200, having right-diagonal segmented regions 114R.I, 114R.II, and 114R.III, segmented regions 114A.I, 114A.II, 114A.III, 114A.IV, and 114A.V, and connector stitch indicators 112J. The connector stitch indicators 112J may be a seam that is sewn, glued, heat welded, or otherwise that securely connects one segmented region to another segmented region 114. The two segmented regions that are connected by the connector stitch indicator may be the same or different in material, texture, color or other defining factor.

In this embodiment, the number of similar consecutive segmented regions indicates to the user what sequence of actions to perform. The user will count the number of similar segmented regions and then follow the instructions to form the correct sequence of actions to create the intended visual design. In one embodiment, the user may be asked to form a number of loops corresponding to the number of consecutive segmented regions. For example, the user may form a single-loop slip stitch with the right-diagonal segmented region 114R.III. In addition, the three consecutive segmented regions 114A.III, 114A.IV, and 114A.V may form three loops of a double crochet stitch. Accordingly, the right-diagonal segmented region 114R.II may form another slip stitch and segmented regions 114A.I and 114A.II may form a single crochet stitch that uses two loops. Lastly, the right-diagonal segmented region 114R.I may form another slip stitch.

In this embodiment, the segmented regions 114A are thicker than right-diagonal segmented regions 114R. The thickness may be a part of the visual design of the textile product. The different thicknesses may create their own pattern or enhance the affect of another pattern, such as a color pattern. More particularly, the difference in thickness may refer to a difference in cross-sectional diameters of the length of material.

Figure 23:
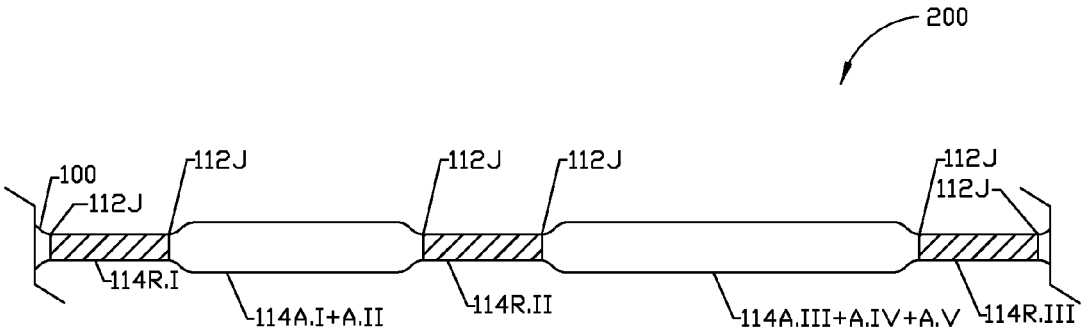

FIG. 23 illustrates an alternative embodiment of a length of material 100 of flexible filament 200, having right-diagonal segments 114R.I, 114R.II, and 114R.III, segmented regions 114A.I+A.II and 114A.III+A.IV+A.V, and connector stitch indicators 112J. In this embodiment, a length of the segmented region indicates a sequence of actions to perform with that segmented region 114. The segmented region 114A.I+A.II is formed of equivalent materials and is the combined lengths of segmented regions 114A.I and 114A.II of FIG. 22. No connector stitch indicators 112J are present in the segmented regions 114A.I+A.II and 114A.III+A.IV+A.V.

In this embodiment, the right-diagonal segmented regions 114R.I, 114R.II, and 114R.III correspond to one loop for a slip stitch. The segmented region 114A.I+A.II is long enough to form two loops that can form a single crochet stitch. In addition, the segmented region 114A.III+A.IV+A.V is long enough to form three loops of a double crochet stitch. Therefore, the length of the segmented regions indicates the sequence of actions to take. As with the embodiment in FIG. 20, this flexible filament is for a more experienced user who can discern the differences in lengths and associate the length with the correct sequence of actions.

Figure 24:
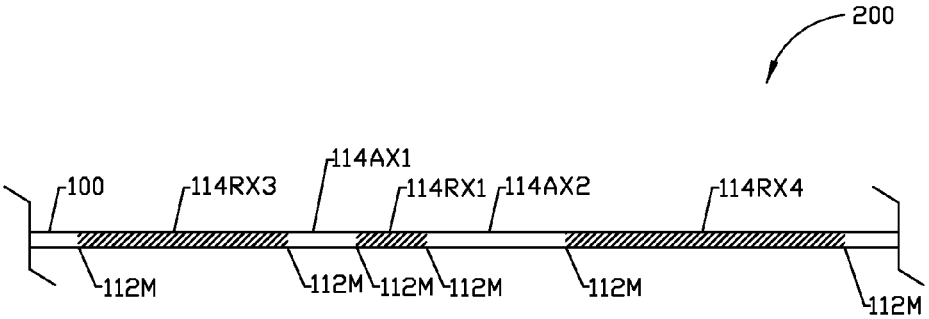

FIG. 24 illustrates a length of material 100 of flexible filament 200, that has transition stitch indicators 112M, right-diagonal segmented regions 114R, and plain segmented regions 114A. The segmented regions may be formed on a spool of yarn that is similar to a standard tubular yarn. In this embodiment, the stitch indicators 112 are not tangible objects or additional marks. Instead, the transition stitch indicators 112M simply mark the transition from one segmented region to a different segmented region. The stitch indicators are visual stitch indicators showing color, texture, or pattern transitions on a consistent length of material. The color, texture, or pattern transitions are appropriately positioned so that the user forms the textile product having the intended visual design with the flexible filament.

Instructions associated with this embodiment may define the right-diagonal segmented regions 114R to be for a knit stitch and the segmented regions 114A to be for a purl stitch. In this embodiment, a length of each segmented region 114 indicates how many stitches to perform. For example, the right-diagonal segmented region 114RX4 may represent four stitches. Therefore, four knit stitches are to be performed with right-diagonal segmented region 114RX4. The segmented region 114AX2 is the length of two stitches and therefore two loops. Therefore, two purl stitches are performed with segmented region 114AX2. The right-diagonal segmented region 114RX1 is the length of one loop, and therefore one knit stitch is to be performed with right-diagonal segmented region 114RX1.

In this embodiment, the color of each segmented region 114 may indicate a sequence of actions, such as a knit or purl stitch to perform. In addition, the length of each segmented region 114 indicates how many sequences to form.

Figure 25:
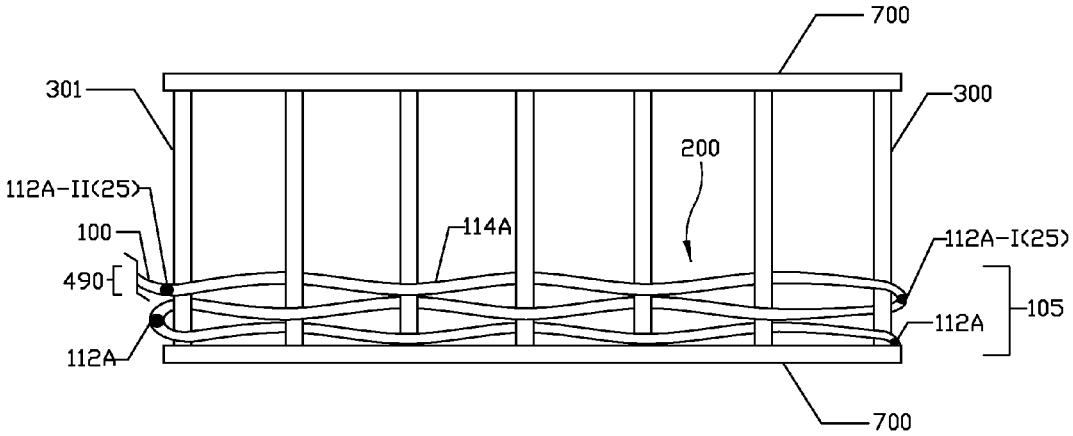
FIG. 25 illustrates a flexible filament having a plurality of stitch indicators and segmented regions woven onto a weaving loom.

FIG. 25 illustrates a length of material 100 of flexible filament 200, using a weft yarn having segmented regions 114A between dot stitch indicators 112A-I(25) and 112A-II (25). The length of material 100 is being woven through warp threads 300, and 301 attached to a loom 700. Weft yarn is yarn that is woven through warp threads 300, and 301 in the craft of weaving.

The stitch indicators 112 may indicate a beginning and end of a row, a portion of a row, or a portion of a sequence of actions. In this embodiment, a row 490 comprises the segmented region 114A between the dot stitch indicators 112A-I(25) and 112A-II(25). The stitch indicators 112A and 112A-I(25)) align with the warp thread 300. In this embodiment, the segmented region 114A is woven through the warp threads six times. When woven with the appropriate amount of tension, the dot stitch indicators 112-II(25) will align with the warp thread 301.

The dot stitch indicator 112A-II(25) meets the warp thread 301 when the row 490 is formed with the correct tension. If the dot stitch indicators 112A-II(25) do not touch the warp thread 301, then the tension of segmented region 114A should be adjusted.

Figure 26:
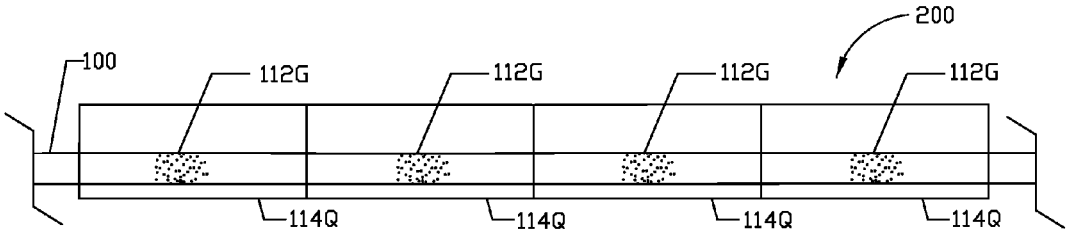
FIG. 26 illustrates a flexible filament having a plurality of stitch indicators and segmented regions with boxes highlighting the areas that begin between one set of stitch indicators and end between another set of stitch indicators.

FIG. 26 illustrates an alternative embodiment of the length of material 100 of flexible filament 200, having middle-sparkled segmented regions 114Q and sparkle stitch indicators 112G. In this embodiment, the stitch indicators are sparkle stitch indicators that are centrally located within a respective segmented region. In the Figure, the ends of the middle-sparkled segmented regions 114Q are illustrated within rectangular boxes. The mid-point between each segmented region indicates a start of one segmented region and an end of another segmented region. If the sequence of actions calls for forming a single loop with the segmented regions, the sparkle stitch indicators would be positioned at a maximum curvature of the loop, furthest away from the securing factor. The sparkle stitch indicators would then be visible on the textile product in a different location than if the stitch indicators were adjacent the securing factors.

The flexible filament of the present disclosure may be configured as a single spool of a length of material, such as a spool of yarn. A length of the flexible filament will depend on the sequence of actions of the intended textile product and the intended size of the textile product. In one embodiment, the single spool of the flexible filament creates the entire textile product. Alternatively, a plurality of spools of the flexible filaments may be connected together to form a larger textile product having one or a plurality of visual designs thereon.

For example, the visual design formed from the flexible filament may be a single letter, such as an "A." The user may desire to form a scarf spelling the name ANN, which would combine three flexible filaments. The flexible filament may form a knitted square forming the letters with colored beads or pom-poms.

The user will first knit the flexible filament forming the letter "A" in accordance with the instructions. The last stitch indicator on the "A" flexible filament may be connected with a first stitch indicator of the flexible filament which has the first "N" to be formed. The two flexible filaments may be connected by tying a knot or by any other secure connection. More particularly, the last stitch indicator of the completed textile product forming the letter "A" will abut the first stitch indicator of the flexible filament that forms the first letter "N." For example, the user will form a connection, such as a knot, so that the ending stitch indicator and the beginning stitch indicator are abutting. The resulting connection may be considered by the user as a single stitch indicator from which a sequence of actions may begin, or continue. When the first "N" construction is complete, the user will similarly connect the second "N" flexible filament to the first "N" construction.

Flexible filaments having a variety of visual designs may be combined to form a larger textile product having a combination of individual designs. Ideally, the combined flexible filaments will be similar in the sense that the methods of manipulation and tools needed are compatible.

Figure 27:
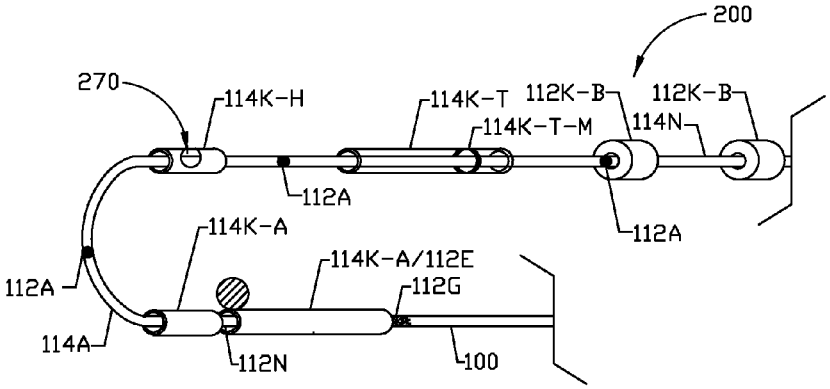
FIG. 27 illustrates a flexible filament having a plurality of sliding and fixed stitch indicators and a plurality of sliding and fixed segmented regions.

FIG. 27 illustrates a length of material 100 of flexible filament 200, that includes a sliding bead indicator 112K-B, a plain sliding segmented region 114K-A, a plain pom-pom sliding segmented region 114K-A/112E, a transparent sliding segmented region 114K-T, and a hole sliding segmented region 114K-H.

The sliding stitch indicators 112K-B may correspond to a fixed stitch indicator 112A that is part of the length of material 100. The sliding stitch can be moved by the user to abut the stitch indicator 112A at the point of emergence (not shown). The user may then form the next sequence of actions, such as forming a knit stitch, so that the sliding stitch indicator is bound between two securing factors. In this embodiment, the sliding bead stitch indicator 112K-B slides along the length of material to meet the associated fixed dot stitch indicator 112A. The sliding stitch indicator 112 would not necessarily be touching the respective fixed stitch indicator 112 until the user is prepared to form the related sequence of actions.

The instructions inform the user of the particular fixed stitch indicators 112 that correspond to the sliding stitch indicators 112K. For example, the color of the dot stitch indicators 112A may indicate to the user which dot stitch indicators should be paired with a bead sliding stitch indicator. Additionally, a sparkle stitch indicator 112G may be paired with a different type of sliding stitch indicator. When the fixed stitch indicator and the sliding stitch indicator are aligned, they may be treated as a single stitch indicator for the purposes of executing a sequence of actions. Other moveable objects may be used for sliding stitch indicators besides beads, for example pom-poms having a hole in the center.

Alternatively, the sliding stitch indicators 112K may cooperate with the fixed stitch indicators to indicate to a user how many stitches or which type of stitch to perform. In this embodiment, the fixed stitch indicator informs the user where a sequence of actions is to begin and the associated sliding stitch indicator indicates the type of sequence of actions, such as a knit stitch. The instructions may inform the user of which sliding stitch indicator relates to particular fixed stitch indicator.

Alternatively, a user may execute the actions indicated by one sliding stitch indicator 112K, using however many fixed stitch indicators required for that action, then slide the next sliding stitch indicator 112K down to abut the point of emergence, then execute the actions which that next sliding stitch indicator indicates, and so on.

The sliding segmented regions 114K may indicate to a user what portion of the length of material to use to form a specific sequence of actions. For example, a length of the sliding segmented regions 114K would equal a length for a particular sequence of actions, such that ends of the sliding segmented region may indicate a beginning and end of that sequence of actions. In this embodiment, the flexible filament may not include sensory stitch indicators at the beginning and end of each segmented region. The user slides the sliding segmented region to abut the point of emergence of the last formed sequence of actions and uses that sliding segmented region and attached stitch indicators as if they were an integral part of the flexible filament. The sliding segmented regions 114K may be flexible and tubular to facilitate movement along the length of material, and manipulation. The sliding segmented region may be used during a sequence of actions to form a portion of the visual design as a loop or other portion of a sequence of actions. In addition, the sliding segmented regions may be removable after the textile product is complete.

Alternatively, the sliding segmented regions 114K are associated with a specific fixed stitch indicator 112. In this embodiment, the pom-pom sliding segmented region 114K-A/112E has been slid to meet the fixed sparkle stitch indicator 112G. The instructions indicate which fixed stitch indicators 112 will pair with each appropriate sliding segmented region 114K. For example, the dot stitch indicators 112A are the same color as the associated sliding segmented region. The instructions may also indicate an optimal position of the sliding stitch indicator with respect to the fixed stitch indicator. For example a first end of the sliding stitch indicator abuts the fixed stitch indicator that is also the point of emergence and a second end extends away from the point of emergence.

Meeting stitch indicator 112N is the point at which two sliding segmented regions meet. This meeting stitch indicator 112N can be treated in the same way as any other stitch indicator 112.

Alternatively, the sliding segmented region 114K may have the fixed stitch indicator positioned centrally, which may be visible through a hole. The hole sliding segmented region 114K-H is an example of the sliding stitch indicator with a hole 270 that may be aligned with a fixed stitch indicator. In this embodiment, the hole sliding segmented region 114K-H would be moved until the appropriate stitch indicator is visible through the hole.

Alternatively, the transparent sliding segmented region 114K-T has a mark 114K-T-M at a location that corresponds to the associated fixed stitch indicator. When correctly positioned, the fixed stitch indicator will be in a corresponding position to the mark 114K-T-M, and at least a portion of the corresponding segmented regions will be visible through the transparent sliding segmented region 114K-T.

The sliding segmented regions 114K may indicate a type or a number of sequences of actions to perform as described in the instructions. In addition, sliding segmented regions may be formed on a length of material that also includes fixed segmented regions.

FIGS. 28A-28D illustrate one example of an alternative embodiment of the stitch indicators. The length of material 100 of flexible filament 200, includes first, second, and third connector stitch indicators 112*y*-1, 112*y*-2, and 112*y*-3, from right to left, respectively, and a first and second segmented region 114*y*-1 and 114*y*-2, respectively. The first connector stitch indicator 112*y*-1 has a first side 10 with a single slot 13 and a second side 12 that is flat. The second connector stitch indicator 112*y*-2 has a first side 14 with two extensions 15 and second flat side 16. The two extensions 15 are sized and shaped so that either extension can be slidably received into the slot 13 in the first connector stitch indicator. The third connector stitch indicator 112*y*-3 has a first side 18 with two slots 17 and a second side 20 that is flat. The slots 17 of the third connector stitch indicator have the same size and shape as the slot 13 of the first stitch indicator. In addition, the extensions 15 of the second connector are configured to be slidably received by the slots 17 of the third connector stitch indicator.

Figure 28A:
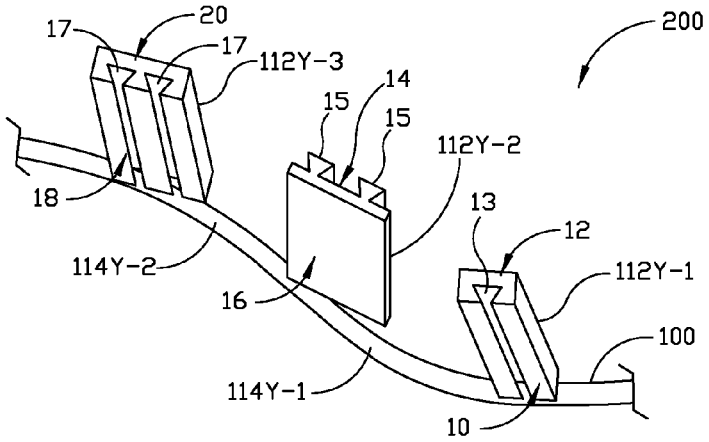
FIGS. 28A-28D illustrate a portion of a flexible filament that includes stitch indicators that may be joined together.
Figure 28B:
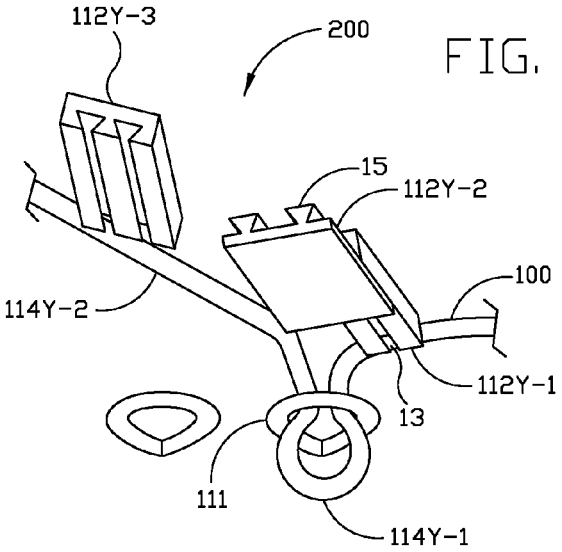

In FIG. 28B, the user performs a sequence of actions with the first segmented region 114*y*-1, forming a loop through a securing factor 111. The first and second connector stitch indicators mark the beginning and end of the first segmented region 114*y*-1. After the sequence of actions is completed, the first and second connector stitch indicators may be joined. This is achieved by sliding one of the extensions 15 of the second connector stitch indicator into the slot 13 of the first connector stitch indicator.

Figure 28C:
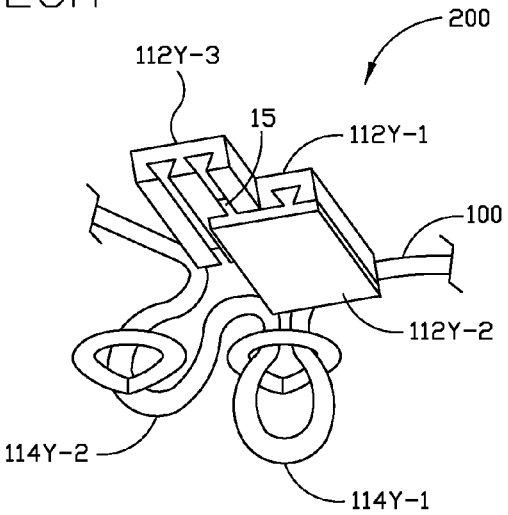

FIG. 28C illustrates the third connector stitch indicator in a process of joining with the remaining extension 15 of the second connector stitch indicator. The third connector stitch indicator may be joined with the second stitch indicator before or during forming of the sequence of actions with the second segmented region 114*y*-2. Depending on the type of connector stitch indicator, other methods of connection can be performed.

Figure 28D:
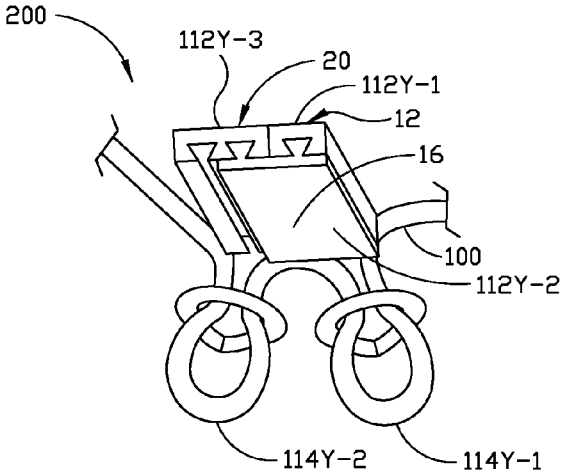

In FIG. 28D, the sequence of actions is completed and the three connector stitch indicators are securely joined. The second sides 12, 16, and 20 of the connector stitch indicators may include a pattern or color that cooperates with the other stitch indicators to form the visual design. The second sides may be like a puzzle, such that when all of the connector stitch indicators are correctly positioned, the visual pattern is visible.

A cross-section of the slots and corresponding extensions of the stitch indicators 112*y*-1, 112*y*-2, and 112*y*-3 is illustrated as triangular. The slot 13 formed in the first stitch indicator 112*y*-1 is a triangular groove that has a wider base in a central section of the stitch indicator with a narrower opening through the first side 10. The extension 15 from the second stitch indicator 112*y*-2 is triangular having a base that corresponds to the wider base of the groove in the first stitch indicator 112*y*-1 and a narrower section that connects the extension 15 to the second stitch indicator 112*y*-2. The narrower section of the second stitch indicator corresponds to the narrow opening in the first side 10 of the first stitch indicator. The first and second stitch indicators are locked into place when the extension 15 is aligned and slid into the groove of the first stitch indicator. In an alternative embodiment, the slot and corresponding extension may be round, diamond shaped, or any other suitable shape, material, or mechanism, that will couple the first and second stitch indicators together.

In this embodiment, the connector stitch indicators cooperate to form a three-dimensional visual design with the flexible filament. For example, the connector stitch indicators may form a castle, or a clasp for a coin purse. The instructions to form the coin purse may include forming a plurality of rows with the flexible filament. The connector stitch indicators may be positioned at the transition between the different rows. When the knitting of the textile product is complete, the connector stitch indicators positioned on opposite edges of the textile product may be joined. The connector stitch indicators may form the opening of the coin purse and the knitted portion may form the body that holds the coins.

Figure 29A:
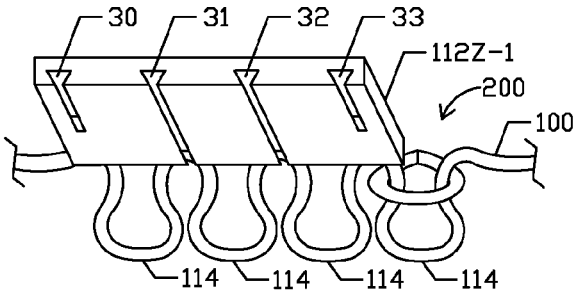
FIGS. 29A-29D illustrate an alternative embodiment of a flexible filament having a multiple stitch indicator.

FIGS. 29A-29D illustrate one example of an alternative embodiment of the stitch indicators. FIG. 29A illustrates a length of material 100 of flexible filament 200, connected to multiple stitch indicator 112Z-1, which is a stitch indicator which serves as multiple stitch indicators. In this embodiment, each part of the flexible filament 200 that is connected to the multiple stitch indicator 112Z-1 is considered to be a stitch indicator belonging to the multiple stitch indicator 112Z-1. In this Figure, multiple stitch indicator 112Z-1 has four slots, 30, 31, 32, and 33, from left to right, respectively.

Figure 29B:
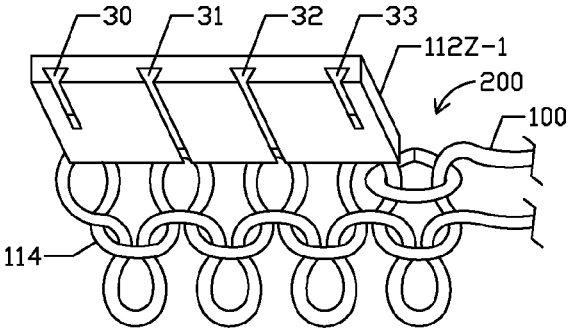

As illustrated in FIG. 29B, the segmented regions 114 between each stitch indicator belonging to multiple stitch indicator 112Z-1 are manipulated appropriately. In this example, each segmented region 114 would comprise the loop for a knit or purl stitch.

Figure 29C:
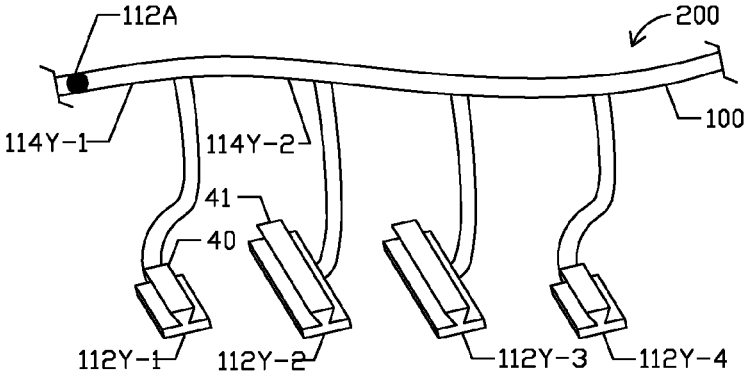

FIG. 29C illustrates dot stitch indicator 112A, and first, second, third and fourth connector stitch indicators 112Y-1, 112Y-2, 112Y-3, and 112Y-4, from left to right, respectively, and a first and second segmented region 114Y-1 and 114Y-2, respectively.

Figure 29D:
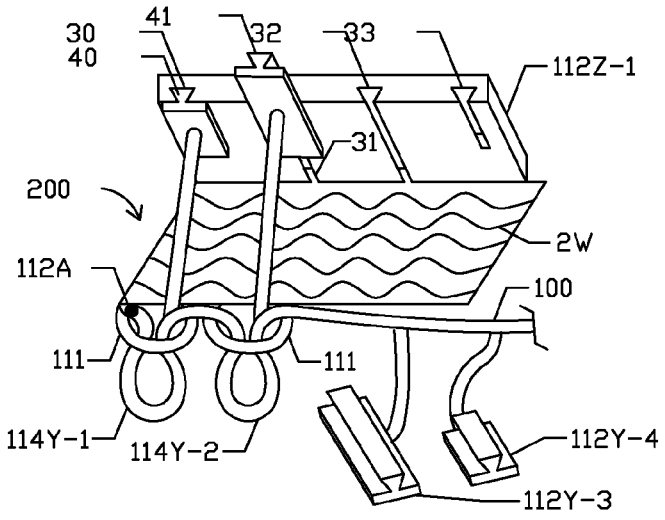

In FIG. 29D, it is shown that in addition to the portion performed in FIG. 29B, more of the portion of textile product has been executed or otherwise formed. In this figure, the wavy lines 2W represent a row of manipulations. In the active row illustrated in FIG. 29D, the user performs a sequence of actions with the first segmented region 114Y-1, forming a loop through a securing factor 111. At or around the time of completion of this sequence of actions, extension 40 of 112Y-1 may be slid into slot 30 of the multiple stitch indicator 112Z-1. Next the user performs a sequence of actions with the second segmented region 114Y-2, forming a loop through a securing factor 111. At or around the time of completion of this sequence of actions, extension 41 of 112Y-2 may be slid into slot 31, and so on for the next two segmented regions and connector stitch indicators. Depending on the type of connector stitch indicator and multiple stitch indicator, other methods of connection can be performed.

The result of this design of flexible filament 200 is that multiple stitch indicator 112Z-1 is more securely positioned at a 90 degree angle to the portion of completed textile product to which it is connected. This type of design may be beneficial in forming such an object as a castle or wall with the flexible filament 200 of this embodiment, its segmented regions, and its stitch indicators.

Figure 30A:
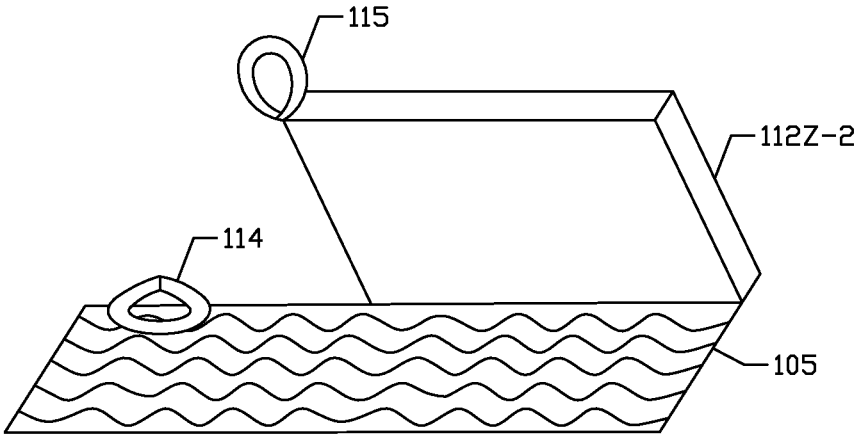
FIGS. 30A and 30B illustrate an alternative embodiment of a flexible filament having a block stitch indicator.
Figure 30B:
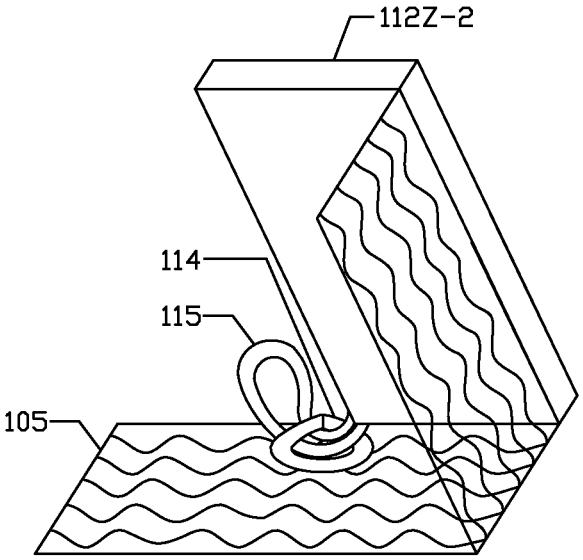

FIG. 30 illustrates loop 115 attached to block stitch indicator 112Z-2 of the length of material 100 of the flexible filament 200. Loop 115 can be used in at least one of three ways. Firstly, it can be used to pass another material through, to tie desired elements of the final design together. Secondly, it can be secured to either another portion of the textile product it is a part of, or thirdly, to another product. FIG. 30B illustrates the second option. In FIG. 30B, a portion 105 of the textile product has already been formed and coupled to a side of the block stitch indicator 112Z-2. The loop 115 is joined to loop 114, which makes the portion 105 of textile product bend to compensate this joining. This makes block stitch indicator 112Z-2 turn onto its left side, and makes the flexible filament attached to it bend to a 90 degree angle. Depending on the placement of loop 115, and where upon the flexible filament that it is joined to, an object (such as a block) could be made to be in other positions, such as laying flush against the flexible filament.

Figure 31A:
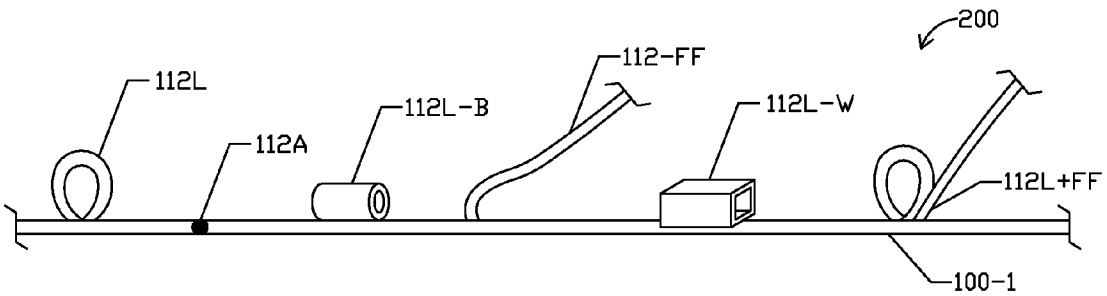
FIGS. 31A and 31B illustrate alternative embodiments of stitch indicators according to the present disclosure.

FIG. 31A illustrates a loop stitch indicator 112L, a dot stitch indicator 112A, a bead loop stitch indicator 112L-B, a flexible filament stitch indicator 112FF, a wood loop stitch indicator 112L-W, and a loop plus flexible filament stitch indicator 112L+FF, upon first length 100-1 of flexible filament 200. Loop stitch indicators may be used in the same manner as other types of stitch indicators. Additionally, before or after manipulation of their associated segmented regions 114, the same or another flexible filament, or another object or material, may be passed through loop stitch indicators 112L.

Figure 31B:
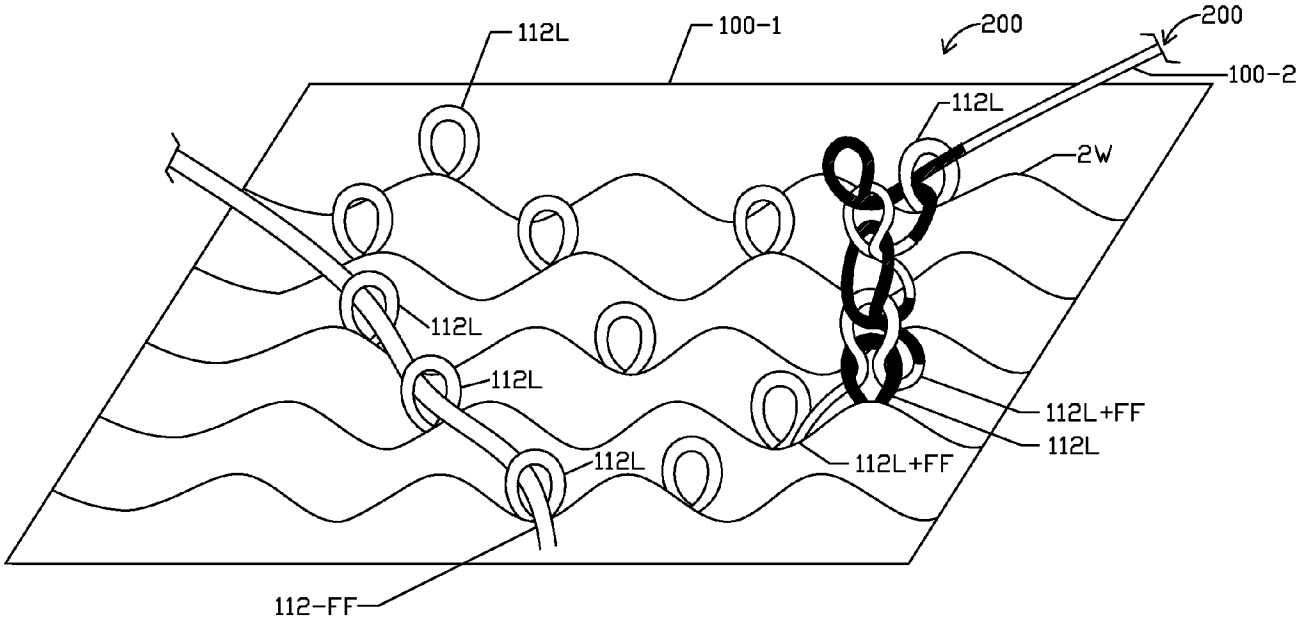

FIG. 31B illustrates one example. In this figure, the wavy lines 2W represent a row of completed manipulations. On the left side, flexible filament stitch indicator 112FF has been passed through some of the loop stitch indicators 112-L.

On the right side, the flexible filament portion of the loop plus flexible filament stitch indicator 112L+FF is a second length 100-2 of the flexible filament of this embodiment which comprises alternating dark and light segmented regions. This length 100-2 is manipulated in the same way as any flexible filament 200 of this embodiment, and it additionally incorporates loop stitch indicators 112L into its manipulation, by being thread or pulled through loop stitch indicators 112L.

By using its stitch indicators and segmented regions appropriately, the second length 100-2 of flexible filament may create its own intended design on top of or otherwise in relation to the portion of textile product containing the loop stitch indicators, length 100-1. In this figure, the second length 100-2 of flexible filament 200 is creating a heart-shaped pattern on top of the textile product made with length 100-1.

Although a second length 100-2 of flexible filament was used and illustrated in FIG. 31B, any object or material that is able to pass through the loop stitch indicators 112L may do so as appropriate to the design.

Figure 32A:
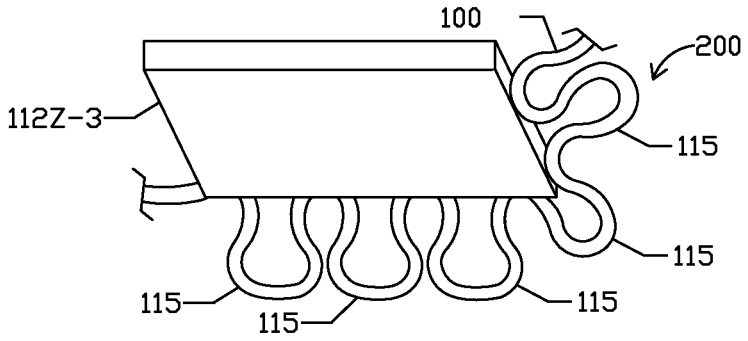
FIGS. 32A-32C illustrate another embodiment of a flexible filament having a multiple stitch indicator.
Figure 32B:
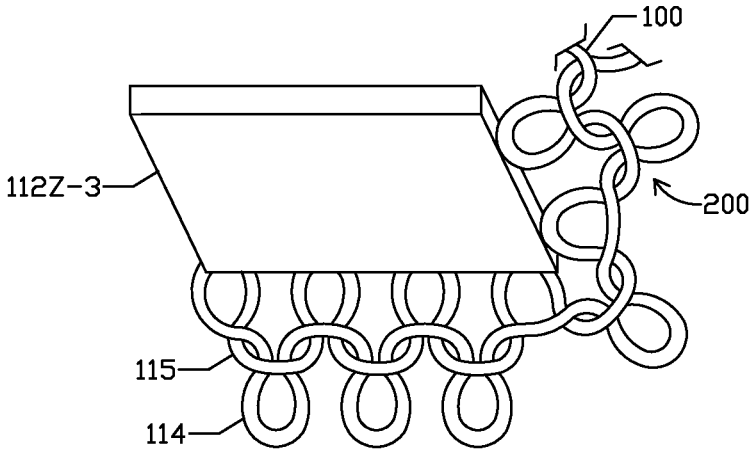

FIG. 32A illustrates multiple stitch indicator 112Z-3 with many loops 115 attached to its right and bottom sides, the loops being part of length 100 of flexible filament 200. FIG. 32B illustrates stitches 114 which are made by incorporating loops 115.

Figure 32C:
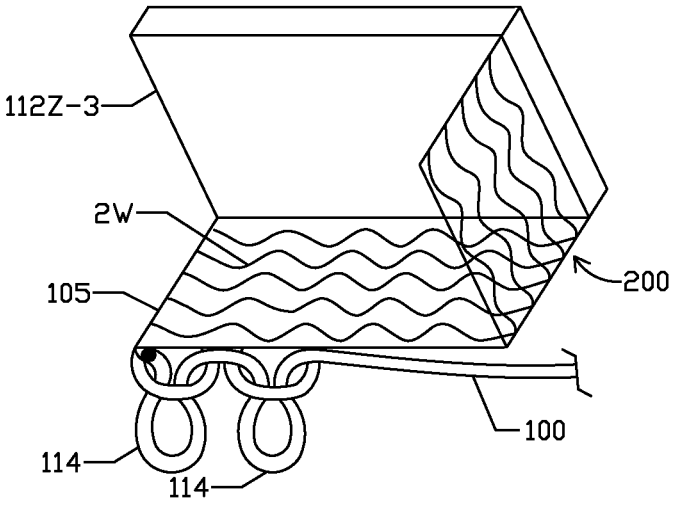

FIG. 32C illustrates a portion 105 of completed flexible filament 200, as well as loops 114. In this figure, the wavy lines 2W represent a row of manipulations. In this Figure, the wavy line closest to multiple stitch indicator 112Z-3, going along the bottom and then up the right side of multiple stitch indicator 112Z-3, represents the row shown in FIG. 32B. The portion 105 is bent at a right angle due to the loops 115 being bent at a right angle around the edge of the multiple stitch indicator following the bottom and right edges of multiple stitch indicator 112Z-3. Similarly, if a multiple stitch indicator takes other shapes, it could also affect the shape of the flexible filament attached to it.

Advantageously, the present disclosure provides users with a flexible filament that will form a textile product having a specific visual design without having to change to a new spool of yarn for a new color or texture. In addition, the flexible filament may have tangible or visual objects that cooperate with each other and with colors or textures of the flexible filament to form the visual design. The user will save time by reducing the cutting and joining of different spools. In addition, the use of scissors is reduced making this flexible filament safer for use by children. Also, incorporating all of the features of a design into a single flexible filament ensures no yarn is wasted. The user will also save money by only purchasing the single flexible filament instead of purchasing multiple spools of yarn of which only a portion may be used in the final design.

By reducing the number of knots or transitions from one spool of yarn to another, the final product will appear less messy and will be more comfortable to handle or wear. The flexible filament also reduces the chance of holes or gaps appearing in the textile product by reducing the number of knots connecting two different spools and by aiding the user in forming consistently shaped stitches.

Additionally, the flexible filament will provide a guide for novice users to make textile products. For example, flexible filaments may be manufactured with children in mind. The flexible filament may be designed for a larger gauge knitting needle and may include large stitch indicators that help children form consistent stitches by resisting movement past the respective securing factors. The flexible filament may include the stitch indicators along the length of material to guide the child to form a single knit stitch with the material between two stitch indicators. In addition, stitch indicators that represent a beginning of a row may be in a different color than the other stitch indicators that indicate the beginning and end of a stitch. An additional example is that stitch indicators associated with a knit stitch may be purples and stitch indicators associated with a purl stitch may be green. Alternatively, the stitch indicators associated with different stitches may be different shapes so that the color is related to the final visual design and not to the particular type of stitch.

The flexible filament also provides novice users with a way to approach more intricate designs that would traditionally be above their skill level. Since the variations of color, texture, and design of the stitch indicators and segmented regions are pre-set in the flexible filament, a user must simply form the appropriate stitch. The textile products that may be formed include, but are not limited to scarves, blankets, toys, shawls, clothing and apparel, hats, socks, afghans, curtains, placemats, and hot-mats.

Additionally, instructions may be provided which specify the indications of certain segmented regions and stitch indicators in regards to what types of stitches to perform. These instructions may provide a method for a user to create a certain pattern involving the sequence of actions indicated by the segmented regions and stitch indicators, without the use of a written pattern. In this way, the user can create the appropriate types of stitches in the appropriate place, while walking or traveling, without needing to refer to a paper pattern.

By starting the first maneuver or manipulation at a point indicated by a stitch indicator 112 or other indicator or other instructions, and using each proceeding segmented region 114 and stitch indicator 112 appropriately, using the appropriate tools, each manipulation will land in a predetermined place, and the appropriate color (or other alteration in appearance, décor, or material) will be pulled up (etc.) in the appropriate location, thereby creating the design it is designed to create. Every color (etc.) will appear at the correct location of the work in progress 105 and the designed pattern will emerge.

While the above description contains many specificities, these should not be construed as limitations on the scope, but rather as an exemplification of several preferred embodiments thereof. Many other variations are possible. The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A flexible filament for forming at least a portion of a textile product by hand, comprising:

a length of material configured to be used in forming the portion of the textile product to have a visual pattern associated with at least one of a first side or a second side of the textile product, the material including:

a plurality of stitch indicators that are spaced at intervals on the material to separate the material into a plurality of segmented regions, at least one of the stitch indicators or the segmented regions forming at least a portion of the visual pattern on the at least one of the first side or the second side of the textile product, wherein the at least one stitch indicator provides a first sensory indication to a user of where at least one part of a stitch is to be executed by hand by the user, and wherein the at least one segmented region provides a second sensory indication to the user of where at least one other part of the stitch is to be executed by hand by the user, to form at least the portion of the visual pattern of the textile product.

2. The flexible filament of claim 1 wherein a first combination of the stitch indicators and the segmented regions cooperate to form at least the portion of the visual pattern of the first side of the textile product.

3. The flexible filament of claim 2 wherein the first combination of the stitch indicators and the segmented regions cooperate to form at least the portion of the visual pattern of the second side of the textile product.

4. The flexible filament of claim 3 wherein the visual pattern of the first side of the textile product is visually distinct from the visual pattern of the second side of the textile product.

5. The flexible filament of claim 3 wherein the visual pattern of the first side of the textile product corresponds to the visual pattern of the second side of the textile product.

6. The flexible filament of claim 1 wherein at least one of the first sensory indications of the at least one stitch indicator and the second sensory indications of the at least one segmented region comprises at least one from among a visual indicator and a tactile indicator.

7. The flexible filament of claim 1 wherein the stitch is at least a portion of at least one stitch and the stitch is a plurality of movements in a sequence.

8. The flexible filament of claim 1 wherein the at least one part of the stitch and the at least one other part of the stitch are each one of a plurality of movements in a sequence.

9. The flexible filament of claim 1 wherein at least one individual stitch indicator corresponds to an end of a segmented region and a beginning of another segmented region.

10. The flexible filament of claim 1 wherein a pair of stitch indicators correspond to a beginning of a segmented region and an end of the same segmented region.

11. The flexible filament of claim 1 wherein at least one from among at least one stitch indicator and at least one segmented region is at least one from among a removable indicator structured to be removed after at least the portion of the textile product is formed with the visual pattern, and a transformable indicator configured to change form upon an application of heat.

12. The flexible filament of claim 1 wherein the at least one stitch indicator corresponds to more than two segmented regions.

13. The flexible filament of claim 1 wherein at least one stitch indicator is configured to join at least one other stitch indicator.

14. The flexible filament of claim 1 wherein at least one stitch indicator couples two segmented regions together.

15. The flexible filament of claim 1 wherein at least one stitch indicator comprises an area of transition between two integrally formed segmented regions.

16. The flexible filament of claim 1 wherein at least one from among the segmented region and the stitch indicator is configured to provide an indication of at least one type of at least one stitch to perform with the flexible filament.

17. The flexible filament of claim 1 wherein at least one or more of the plurality of segmented regions or at least one or more of the plurality of stitch indicators is configured to provide an indication of a length of the flexible filament to use to form at least a portion of the at least one type of at least one stitch.

18. The flexible filament of claim 1 wherein the material includes at least one from among yarn, thread, ribbon, rope, wool, embroidery thread, floss, straw, rubber thread, rubber yarn, fishing line, cloth, felt, acrylic, micro-fiber acrylic, rayon, rayon from bamboo, polyamide, nylon, cotton, polyester, cupro, cashmere, mohair, silk, merino, stainless steel, suede, velvet, acetate, filament silk, angora, plastic, glow-in-the-dark material, cord, and paper.

19. A method, comprising:

manufacturing a flexible filament that is configured to be manipulated by hand by a user to form at least a part of a textile product, the textile product having a visual pattern on a first side of the textile product, the manufacturing including:

forming a single length of textile material; and forming a plurality of segmented regions on the length of textile material by forming a plurality of stitch indicators on the material, the plurality of stitch indicators separating the material into the plurality of segmented regions, at least one of the stitch indicators or segmented regions forming at least a portion of the visual pattern on first side of the textile product after being manipulated by the user, the stitch indicators or the segmented regions providing a visual or tactile indication to the user of a portion of a stitch to perform.

20. The method of claim 19 wherein at least one of the segmented regions is configured to indicate to a user at least one type of stitch to be formed by hand and to represent a length of the flexible filament to use to form the at least one type of stitch.

21. The method of claim 19, further comprising:

forming at least one of the stitch indicators to be a large stitch indicator that is larger than a width of at least a portion of at least one stitch, the large stitch indicator configured to resist movement of the segmented region that precedes the large stitch indicator.

22. The method of claim 19 wherein the stitch indicators and the segmented regions are configured to form a number of rows having a number of stitches that correspond to a width and a length of at least the portion of the visual pattern.

23. The method of claim 19 wherein the flexible filament is configured to accommodate a plurality of stitches, wherein at least one pair of the stitch indicators are configured to indicate where to manually form at least one of the stitches, to contribute to at least the part of the visual pattern of the textile product.

24. The method of claim 19 wherein at least one of the stitch indicators is configured to indicate a type of stitch to perform with at least one respective segmented region.

25. A flexible filament configured to be used to form a textile product by hand, comprising:

a single length of material configured to be used to form the textile product to have a visual pattern on at least one of a first side or a second side of the textile product, the material comprising:

a plurality of stitch indicators formed on the material;

a plurality of segmented regions between consecutive ones of the plurality of stitch indicators, the plurality of stitch indicators separating the material into the plurality of segmented regions, at least one of the stitch indicators or the segmented regions configured to form at least the portion of the visual pattern on the at least one of the first side or the second side of the textile product, at least one of the plurality of stitch indicators or the plurality of segmented regions being configured to provide a visual or tactile indication to a user about at least a portion of a stitch to perform.

26. The flexible filament of claim 25 wherein each pair of stitch indicators provides the visual or tactile indication of where the stitch is to be executed.

27. The flexible filament of claim 25 wherein the stitch indicators are spaced at intervals on the material, a pair of stitch indicators configured to correspond to a beginning of a segmented region and an end of the segmented region.

28. The flexible filament of claim 25 wherein at least one of the stitch indicators is at least one from among a removable indicator structured to be removed after the textile product is formed with the visual pattern and a transformable indicator configured to change form upon an application of heat.

29. The flexible filament of claim 25 wherein at least one of the segmented regions or the stitch indicators is configured to provide an indication of a type of stitch to be formed with the flexible filament.

30. A textile product formed by using a flexible filament having a plurality of stitch indicators formed on a length of material to separate the material into a plurality of segmented regions, at least one of the stitch indicators or the segmented regions forming at least a portion of a visual pattern on at least one side of the textile product, and manually forming a plurality of stitches with the flexible filament using the stitch indicators as a sensory indication of where to position the stitches to form at least the portion of the visual pattern.

31. The product of claim 30 wherein at least one of the stitch indicators or the segmented regions indicate a type of stitch to perform.

32. The product of claim 30 wherein at least one or more of the segmented regions indicate a type of stitch and a length of the flexible filament to use to form the stitch.

* * * * *